US007551862B2

(12) United States Patent
Tanaka et al.

(10) Patent No.: US 7,551,862 B2
(45) Date of Patent: Jun. 23, 2009

(54) DEVELOPING DEVICE, AND PROCESS UNIT AND IMAGE FORMING APPARATUS USING THE DEVELOPING DEVICE

(75) Inventors: Kayoko Tanaka, Edogawa-ku (JP); Shin Hasegawa, Zama (JP); Kohta Fujimori, Yokohama (JP); Nobutaka Takeuchi, Yokohama (JP); Yushi Hirayama, Sagamihara (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 11/761,731

(22) Filed: Jun. 12, 2007

(65) Prior Publication Data

US 2007/0286617 A1 Dec. 13, 2007

(30) Foreign Application Priority Data

Jun. 13, 2006 (JP) ..... 2006-163567

(51) Int. Cl.
*G03G 15/08* (2006.01)

(52) U.S. Cl. ..... 399/30; 399/58

(58) Field of Classification Search ..... 399/30, 399/53, 58, 59, 60, 61, 62, 254, 255, 258
See application file for complete search history.

(56) References Cited

U.S. PATENT DOCUMENTS 5,237,372 A * 8/1993 Ishii et al. ..... 399/30
6,006,050 A * 12/1999 Watanabe et al. ..... 399/58
6,181,892 B1 1/2001 Fujimori
6,366,751 B1 4/2002 Shakuto et al.
6,665,511 B2 12/2003 Takeuchi et al.
6,690,896 B2 2/2004 Hanada et al.
6,757,509 B2 6/2004 Shoji et al.
6,819,901 B1 11/2004 Yasutomi et al.
6,823,163 B2 11/2004 Sugimoto et al.
6,856,780 B2 2/2005 Kadota et al.

(Continued)

FOREIGN PATENT DOCUMENTS

JP 3-59580 3/1991

(Continued)

OTHER PUBLICATIONS

U.S. Appl. No. 11/932,198, filed Oct. 31, 2007, Takeuchi, et al.

*Primary Examiner*—David M Gray
*Assistant Examiner*—Bryan P Ready
(74) *Attorney, Agent, or Firm*—Oblon, Spivak, McClelland, Maier & Neustadt, P.C.

(57) ABSTRACT

A developing device including a developer bearing member configured to configured to bear thereon a developer including a toner and a magnetic carrier to develop an electrostatic image on an image bearing member with the developer; a developer container configured to contain and feed the developer to the developer bearing member; a toner concentration sensor configured to detect a concentration of the toner in the developer in the developer container and output a signal depending on the detected toner concentration; and a characteristic information storage device configured to store a characteristic of the toner concentration sensor, wherein the sensor information storage device is separated from the toner concentration sensor. A process unit including an image bearing member and the developing device. An image forming apparatus including an image bearing member, the developing device and a controller.

20 Claims, 13 Drawing Sheets

U.S. PATENT DOCUMENTS

| | | | | |
|---|---|---|---|---|
| 7,024,141 | B2 | 4/2006 | Takeuchi et al. | |
| 7,103,305 | B2 | 9/2006 | Koike et al. | |
| 7,116,932 | B2 | 10/2006 | Takeuchi et al. | |
| 7,127,198 | B2 | 10/2006 | Muramatsu et al. | |
| 7,171,145 | B2 | 1/2007 | Takeuchi et al. | |
| 2004/0202485 | A1* | 10/2004 | Uyama | 399/27 |
| 2004/0265015 | A1 | 12/2004 | Koike et al. | |
| 2005/0063715 | A1* | 3/2005 | Suzuki et al. | 399/27 |
| 2005/0232648 | A1* | 10/2005 | Nishizawa et al. | 399/49 |
| 2005/0265759 | A1 | 12/2005 | Takeuchi et al. | |
| 2006/0008281 | A1* | 1/2006 | Matsumoto et al. | 399/27 |
| 2007/0036566 | A1 | 2/2007 | Takeuchi et al. | |
| 2007/0053703 | A1 | 3/2007 | Hirayama | |

FOREIGN PATENT DOCUMENTS

| | | |
|---|---|---|
| JP | 3-87869 | 4/1991 |
| JP | 8-110734 | 4/1996 |
| JP | 2000-56554 | 2/2000 |
| JP | 2000-267424 | 9/2000 |
| JP | 2003-330258 | 11/2003 |
| JP | 3518852 | 2/2004 |

* cited by examiner

DEVELOPING DEVICE, AND PROCESS UNIT AND IMAGE FORMING APPARATUS USING THE DEVELOPING DEVICE

BACKGROUND OF THE INVENTION

1. Field of the Invention

The present invention relates to a developing device configured to develop an electrostatic image with a developer including a toner and a magnetic carrier. In addition, the present invention also relates to a process unit and an image forming apparatus using the developing device.

2. Discussion of the Background

Developing devices, which develop an electrostatic image formed on an image bearing member such as photoreceptors using a developer including a toner and a magnetic carrier to form a visual image, have been used for image forming apparatuses such as copiers, facsimiles and printers. In such developing devices, the developer is fed to a developing region, at which a developer bearing member (such as developing rollers) faces the image bearing member, while borne on the developer bearing member, and the toner present on the surface of the magnetic carrier in the developer is attracted by an electrostatic image on the image bearing member, resulting in formation of a toner image thereon. The developer (magnetic carrier) used for development is returned from the developer bearing member to a developer containing portion of the developing device to be reused. Since the toner is thus consumed, the concentration of toner in the developer contained in the developing devices gradually decreases. Therefore, it is typically performed that the concentration of toner in the developer is detected by a sensor, and a new toner (i.e., a fresh toner) is properly supplied to the developing devices to control the toner concentration so as to fall in a predetermined range.

Such a sensor is used not only for detecting the concentration of toner in a developer contained in a developing device, but also for determining whether a fresh developer (hereinafter sometimes referred to as an initial developer) is properly set in the developing devices. For example, when the developer in an image forming apparatus is replaced with an initial developer, a new cartridge, which has an initial developer container in which the initial developer is contained while sealed to prevent occurrence of developer scattering, is typically used. A user sets the new cartridge in the image forming apparatus and removes the seal to feed the initial developer to an agitating section of the developing device. In this regard, if the initial developer is not well fed to the agitating section (for example, due to unsealing), a problem in that the sensor judges that the toner concentration is low, and thereby a fresh toner is continuously fed to the developing device may occur. In order to prevent occurrence of such a problem, the sensor is also used for determining whether an initial developer is properly set in the developing device.

Such toner concentration sensors are typically sensors which detect the concentration of toner in a developer by measuring the magnetic permeability of the developer and output a voltage depending on the magnetic permeability. Specifically, when the concentration of toner in a developer changes, the magnetic permeability of the developer changes. Therefore, the concentration of toner in the developer can be determined by measuring the magnetic permeability of the developer. In recent years, various high sensitive sensors which can measure magnetic permeability with high accuracy have been proposed and/or developed.

However, the present inventors discover that when such a high sensitive sensor is used, a problem in that the advantage thereof cannot be well used or a problem in that the toner concentration is mistakenly determined often occurs. Specifically, sensors having a relatively low sensitivity (i.e., the rate of change of the output voltage from the sensors is low against change of the magnetic permeability of a material (e.g., developer) to be measured) have a property such that variation of sensitivity among the same sensors is relatively small (i.e., have a small individual variation in sensitivity). Therefore, the control parameter (such as shift in output voltage against change of toner concentration of 1%) can be set to one preset value even when two or more of the same sensor are used. In contrast, high sensitive sensors have an advantage of being capable of measuring the toner concentration with high accuracy but have a drawback in that variation in sensitivity is relatively large when two or more of the same sensor are used. When such high sensitive sensors are used, the control parameter has to be set to the intermediate value of the range within which the control parameter of the sensors changes. Therefore, a problem in that the control parameter shifts from the proper value for a sensor depending on the property of the sensor can occur. In this case, the advantage of the high sensitive sensors cannot be used.

As a result of the present inventors' study, we found that it is difficult for high sensitive sensors to determine whether an initial developer is present in a developing device while measuring the toner concentration with high accuracy. Specifically, toner concentration sensors such as low sensitive sensors and high sensitive sensors output a voltage by changing the voltage input thereto depending on the magnetic permeability of the developer. In this regard, the level of the output voltage largely changes depending on choice of sensor even when the same kinds of sensors are used. For example, there is a case in which when the magnetic permeability of the same developer is measured with two of the same sensors while the same voltage is input to the sensors, one of the same sensors outputs a voltage of 2.5V but the other sensor outputs a voltage of 2.9V. In this case, the toner concentration of the developer cannot be accurately measured with the sensor. In order to prevent occurrence of such a problem, an initial input voltage correction operation such that when an image forming apparatus starts to be used or a developing device of the image forming apparatus is replaced with a new developing device, the voltage input to the toner concentration sensor thereof is changed so that the output voltage of the sensor becomes equal to the predetermined voltage is typically performed. By performing this correction operation, the output level of the sensor can be adjusted even when the sensor has a large variation in sensitivity. However, the operation of determining whether or not an initial developer is properly set has to be performed before the initial input voltage correction operation. Therefore, the output level variation problem of the sensor is not solved at this stage.

Conventional low sensitivity toner concentration sensors have such a relatively small variation in output voltage as to be able to determine whether or not the initial developer is properly set. Specifically, when a low sensitivity toner concentration sensor is used, it can be determined by low sensitivity toner concentration sensors without causing a problem that an initial developer is properly set, if the voltages of the sensors are less than a threshold (for example, 0.5V). However, the present inventors discover that high sensitive sensors cannot have such a threshold when considering the variation thereof. Namely, when a threshold is set for a high sensitive sensor, a problem in that it is mistakenly determined by the sensor that an initial developer is properly set even if the initial developer is not set in reality, or vice versa occurs.

Because of these reasons, a need exists for a developing device which can properly determine the toner concentration while properly determining whether or not an initial developer is set even when a (high sensitive) sensor having relatively large variation is used.

SUMMARY OF THE INVENTION

As an aspect of the present invention, a developing device is provided which includes a developer bearing member configured to bear thereon a developer including a toner and a magnetic carrier to develop an electrostatic image on an image bearing member with the developer; a developer container configured to contain and feed the developer to the developer bearing member; a toner concentration sensor, which detects the concentration of the toner in the developer in the developer container and outputs a signal depending on the detected toner concentration; and a sensor information storage device configured to store the characteristic of the toner concentration sensor. The sensor information storage device is separated from the toner concentration sensor. The sensor information storage device is preferably a storage device capable of electrically storing information, although other storage devices and media such as barcodes can also be used.

As another aspect of the present invention, a process unit is provided which includes an image bearing member configured to bear an electrostatic image thereon; and the developing device mentioned above, wherein the image bearing member and the developing device are detachably set in an image forming apparatus as a unit.

As a yet another aspect of the present invention, an image forming apparatus is provided which includes an image bearing member configured to bear an electrostatic image thereon; the developing device mentioned above; and a controller configured to perform controlling on the basis of the information from the toner concentration sensor.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

At first, an electrophotographic printer, which is an example of the image forming apparatus of the present invention, will be explained.

Figure 1:
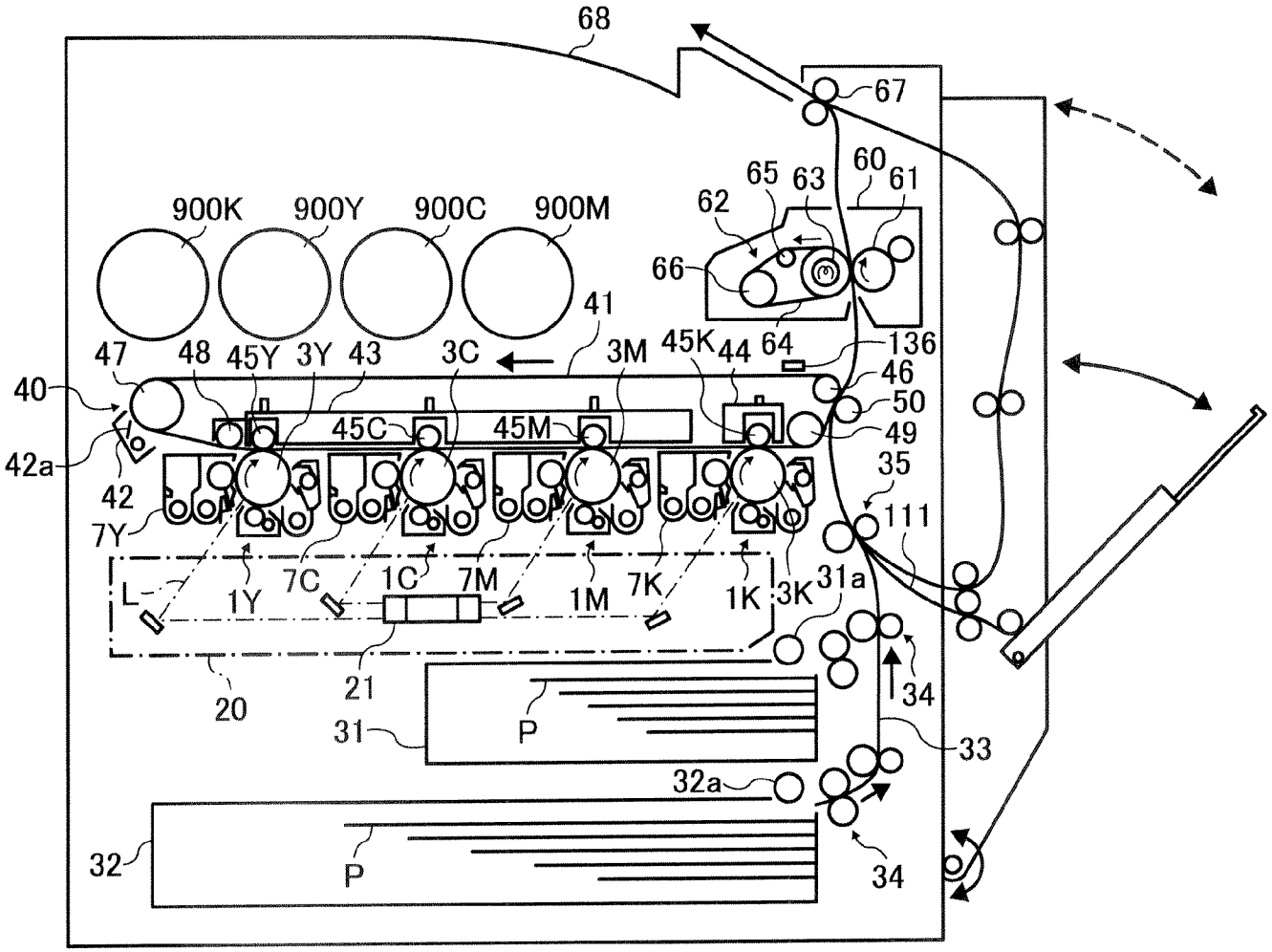
FIG. 1 is a schematic view illustrating a printer according to an example of the image forming apparatus of the present invention.

The configuration of the printer is illustrated in FIG. 1. The printer has four process units 1Y, 1M, 1C and 1K for forming yellow, magenta, cyan and black toner images, respectively, each of which serves as a toner image forming device The process units have the same configuration except that different color toners (yellow, magenta, cyan and black color toners) are used for forming images. Therefore, only the yellow process unit 1Y will be explained.

Figure 2:
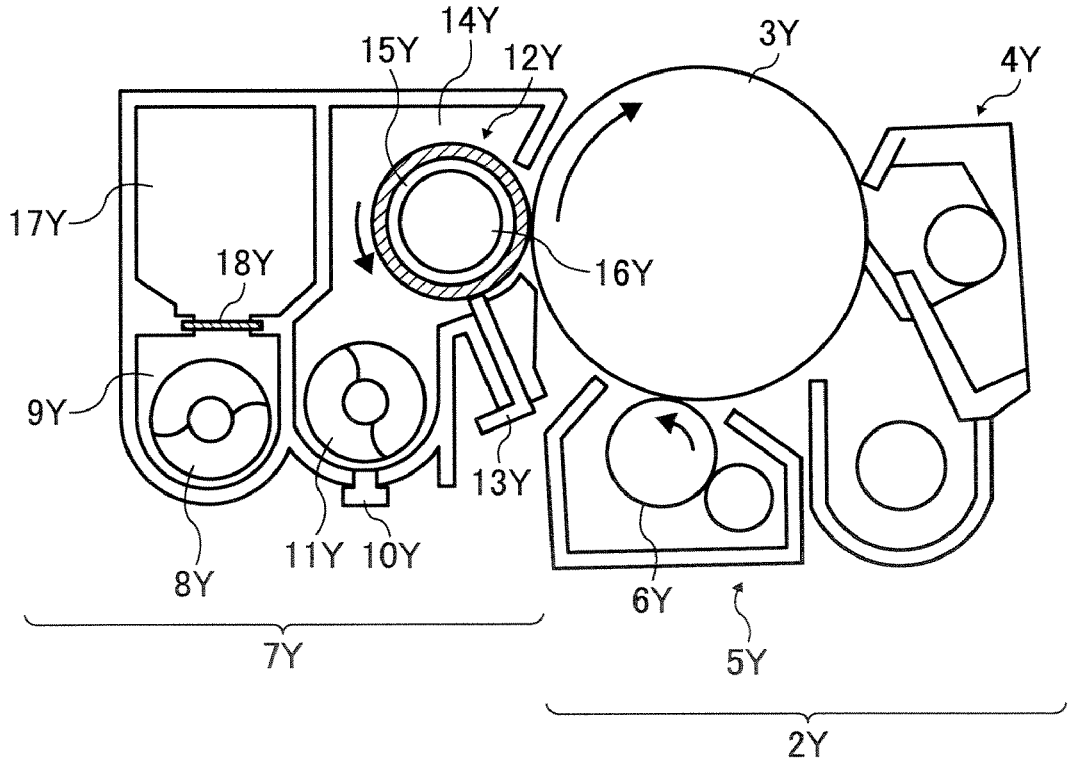
FIG. 2 is an enlarged view illustrating the yellow process unit of the printer illustrated in FIG. 1.
Figure 3:
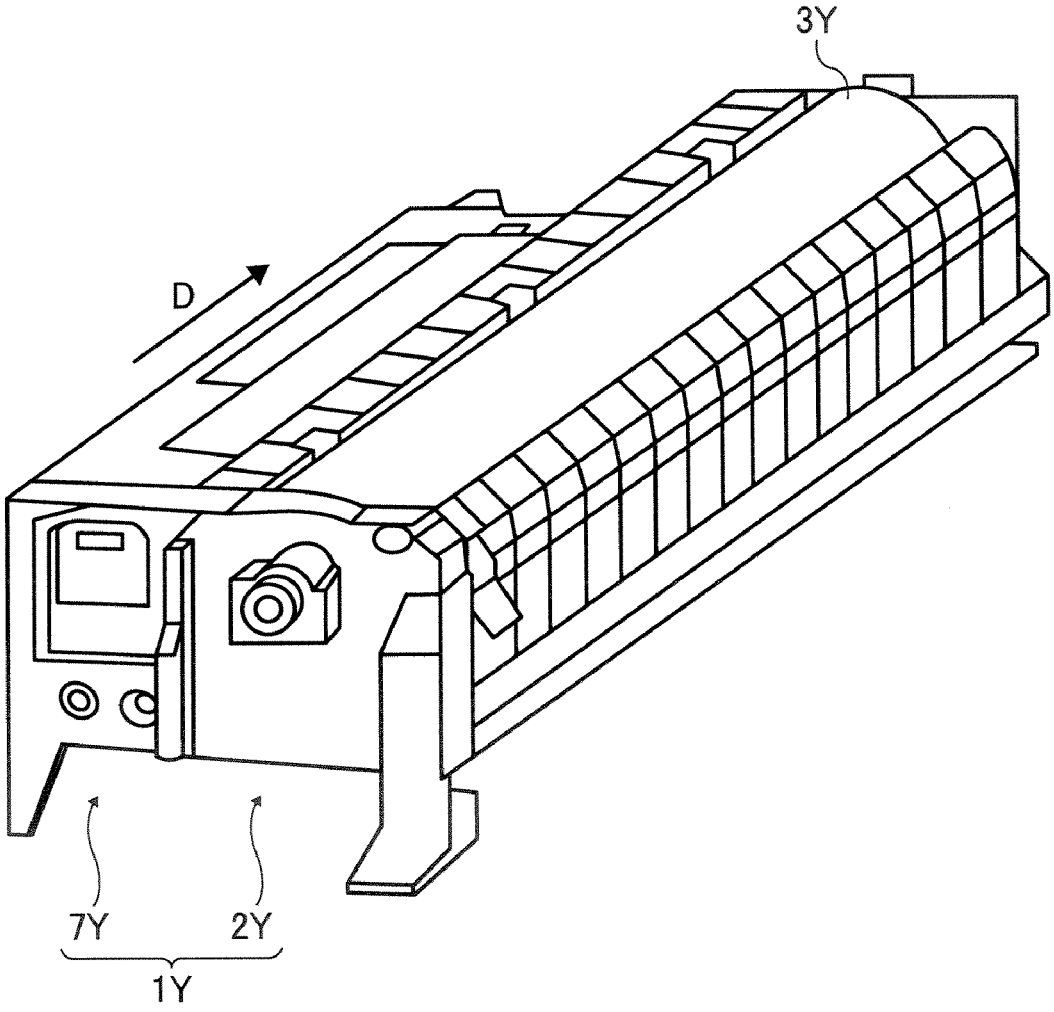
FIGS. 3 and 4 are perspective views illustrating the yellow process unit illustrated in FIG. 2.
Figure 4:
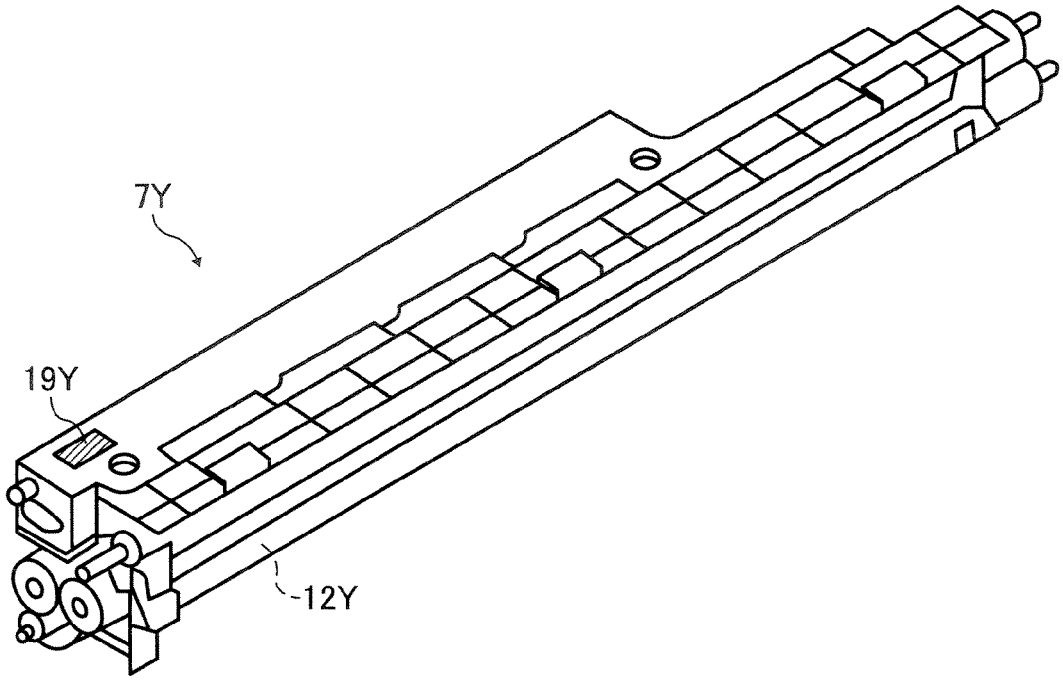

Referring to FIG. 2, the yellow process unit 1Y includes a photoreceptor unit 2Y and a developing unit 7Y. As illustrated in FIG. 3, the photoreceptor unit 2Y and developing unit 7Y are united so as to be detachably set in the printer as a unit. In addition, as illustrated in FIG. 4, the developing unit 7Y can be detached from the photoreceptor unit 2Y (not shown in FIG. 4). Referring to FIG. 2, the photoreceptor unit 2Y includes a photoreceptor drum 3Y which serves as an image bearing member configured to bear an electrostatic image thereon, a photoreceptor drum cleaning device 4Y configured to clean the surface of the photoreceptor drum, a charging device 5Y, a discharging device (not shown) configured to reduce the charge remaining on the photoreceptor drum even after an image transfer operation, etc.

The charging device 5Y charges the surface of the photoreceptor drum 3Y while being clockwise rotated by a driving device (not shown). Specifically, a charge bias is applied by a power source (not shown) to a short-range charging roller 6Y of the charging device 5Y, which roller is set so as to be close to the surface of the photoreceptor drum 3Y while counterclockwise rotated, to uniformly charge the photoreceptor drum. Instead of such a short-range charging roller, charging brushes which perform charging while being contacted with the photoreceptor drum 3Y, scorotron chargers which charge the photoreceptor drum utilizing corona discharging, etc., can also be used. The thus charged photoreceptor drum 3Y is exposed to a laser beam which includes a yellow color image information and which is scanned by an optical writing unit mentioned later, resulting in formation of an electrostatic latent image of the yellow color image on the photoreceptor drum 3Y.

Referring to FIG. 2, the developing unit 7Y serving as a developing device includes a first developer container 9Y in which a first feeding screw 8Y is arranged; and a second developer container 14Y, which includes a toner concentration sensor 10Y including a magnetic permeability sensor, a second feeding screw 11Y, a developing roller 12Y, a doctor blade 13Y, etc. The first and second developer containers include a yellow developer including a carrier and a negatively charged yellow toner. The first feeding screw 8Y is rotated by a driving device (not shown) to feed the yellow developer in a direction indicated by an arrow D (illustrated in FIG. 3) The thus fed yellow developer is fed to the second developer container 14Y through an opening (not shown) provided on a partition between the first developer container and the second developer container.

The second feeding screw 11Y is rotated by a driving device (not shown) to feed the yellow developer in the direction opposite to the direction D. The concentration of toner in the developer thus fed by the second feeding screw 11Y is detected by the toner concentration sensor 10Y. The developing roller 12Y is located over the second feeding screw 11Y while extending so as to be parallel to the second feeding screw 11Y. The developing roller 12Y includes a developing sleeve 15Y which is a non-magnetic pipe and which is counterclockwise rotated, and a magnet roller 16Y which is arranged in the developing sleeve 15Y. A part of the developer fed by the second feeding screw 11Y is attracted to the surface of the developing sleeve 15Y by the magnetic force of the magnet roller 16Y. The developer on the surface of the developing sleeve 15Y is rotated together with the developing sleeve and is scraped with the doctor blade 13Y, resulting in formation of a developer layer on the surface of the developing sleeve 15Y. When the developer layer reaches a developing region, at which the developing sleeve 15Y faces the photoreceptor drum 3Y, the yellow toner in the developer layer is attracted to an electrostatic latent image on the photoreceptor drum 3Y, resulting in formation of a yellow toner image thereon.

The developer, from which the yellow toner is released to develop an electrostatic latent image, is returned to the second feeding screw by the rotated developing sleeve 15Y. When the developer is fed to a front edge of the second developer container 14Y (i.e., an edge of the second developer container on the downstream side relative to the developer feeding direction opposite to the direction D in FIG. 3), the developer is returned to the first developer container 9Y through an opening (not shown).

The data of the magnetic permeability of the yellow developer, which is measured with the toner concentration sensor 10Y, are sent to a controller (not shown in FIGS. 1 and 2) as a form of voltage (i.e., a voltage signal). Since the magnetic permeability of the developer correlates to the concentration of toner in the developer, the toner concentration sensor 10Y outputs a voltage depending on the toner concentration. The controller includes a RAM which is a nonvolatile memory. The RAM stores data such as Vt_ref(Y), which is a target of the voltage output from the yellow toner concentration sensor 10Y, and Vt_ref(M), Vt_ref(C) and Vt_ref(K), which are targets of the voltages output from the magenta, cyan and black toner concentration sensors 10M, 10C and 10K, respectively.

The voltage output by the yellow toner concentration sensor 10Y is compared with the target Vt_ref(Y), and the controller operates a yellow toner supplying device (not shown) for a time, which is determined on the basis of the comparison result. By performing this toner supplying operation, a proper amount of a fresh yellow toner is supplied to the developer, in which the yellow toner concentration is decreased due to use of the yellow toner for yellow toner image formation, in the first developer container 9Y. Therefore, the concentration of toner in the developer in the second developer container 14Y is controlled so as to fall within a predetermined range. Similar toner supplying operations are performed in the other developing units 7M, 7C and 7K.

The yellow toner image formed on the photoreceptor drum 3*y* is transferred onto an intermediate transfer medium mentioned later. The photoreceptor drum cleaning device 4Y removes toner particles remaining on the surface of the photoreceptor drum 3Y even after the intermediate image transfer process. The photoreceptor drum 3Y is then subjected to a discharge treatment by the discharging device (not shown). Thus, the photoreceptor drum 3Y is initialized so as to be ready for the next image forming operation. Similarly, cyan, magenta and black toner images are formed on the respective photoreceptors 3C, 3M and 3K, and the toner images are transferred onto the intermediate transfer medium.

Referring to FIG. 1, an optical writing unit 20 is provided under the process units 1Y, 1C, 1M and 1K to irradiate the photoreceptors 3Y, 3C, 3M and 3K with the corresponding laser beams including information of yellow, cyan, magenta and black color images, respectively, resulting in formation of electrostatic latent images of the yellow, cyan, magenta and black color images on the photoreceptor drums 3Y, 3C, 3M and 3K, respectively.

In the optical writing unit 20, a laser light beam L emitted by a light source is deflected by a polygon mirror 21, which is rotated by a motor, and passes through a lens and a mirror to scan the surface of one of the photoreceptor drums. Instead of such an optical writing device, an optical writing device using a light emitting diode array can be used.

A first cassette 31, and a second cassette 32 are arranged under the optical writing unit 20 so as to be overlaid as illustrated in FIG. 1. In each of the first and second cassettes 31 and 32, plural sheets of a receiving material P are contained. The uppermost sheets in the first and second cassettes 31 and 32 are contacted with a first feeding roller 31*a* and a second feeding roller 32*a*, respectively. When the first feeding roller 31*a* is counterclockwise rotated by a driving device (not shown) the uppermost sheet in the first cassette 31 is fed toward a feeding passage 33. Similarly, when the second feeding roller 32*a* is counterclockwise rotated by a driving device (not shown), the uppermost sheet in the second cassette 32 is fed toward the feeding passage 33. Since plural pairs of rollers 34 are provided in the feeding passage 33, the sheet p fed into the feeding passage 33 is fed upward in the feeding passage 33 while sandwiched by the pairs of rollers 34.

At the end of the feeding passage 33, a pair of registration rollers 35 are arranged. When the pair of registration rollers 35 pinches the sheet P fed by the pairs of rollers 34, the rollers stop rotation thereof. The registration rollers 35 timely rotate to feed the sheet P toward a secondary transfer nip mentioned below so that a toner image on the intermediate transfer medium is transferred onto a proper position of the fed sheet P.

Above the process units 1, a transfer unit 40 serving as a transfer device is provided in which an intermediate transfer belt 41 serving as an intermediate transfer medium makes a counterclockwise endless movement while being tightly stretched by plural rollers. The transfer unit 40 includes the intermediate transfer belt 41, a belt cleaning unit 42, a first bracket 43, a second bracket 44, primary transfer rollers 45Y, 45C, 45M and 45K, a secondary backup roller 46, a driving roller 47, a support roller 48 and a tension roller 49. The intermediate transfer belt 41 is allowed to make a counterclockwise endless movement by the driving roller 47 while tightly stretched by these eight rollers. The primary transfer rollers 45 and the photoreceptor drums 3 sandwich the intermediate transfer belt 41, resulting in formation of four primary transfer nips. Each of the primary transfer roller 45 applies a transfer bias with a polarity opposite to that of the charge of the toner used to the backside of the intermediate transfer belt 41. The primary transfer rollers 45 transfer the color toner images on the photoreceptor drums 3 to the intermediate transfer belt 41 at the primary transfer nips so that the color toner images are overlaid in the intermediate transfer belt. Thus, a four-color toner image is formed on the intermediate transfer belt 41.

Each of the primary transfer rollers 45 has a structure such that an elastic layer is formed on a metal shaft (such as a stainless shaft) having a diameter of, for example, 8 mm. The elastic layer is made of a rubber (such as polyurethane, EPDM and silicone rubbers), which has a solid state or a foamed (sponge) state and which includes an electroconductive material such as carbon blacks or an ionic conductive material to have a volume resistivity of from about $10^5$ to about $10^9$ Ω·cm. The elastic layer has a thickness of about 5 mm, and an Asker-C hardness of from 20 to 70°.

The intermediate transfer belt 41 is an endless belt having a volume resistivity of from $10^6$ to $10^{12}$ Ω·cm. Suitable materials for use in the intermediate transfer belt 41 include polycarbonate resins (PC), polyimide resins (PI), polyamideimide resins (PAI), polyvinylidene fluoride resins (PVDF), tetrafluoroethylene-ethylene copolymers (ETFE), etc. In addition, rubbers such as EPDMs, NBRs, CRs, polyurethane rubbers can also be used. A filler such as electroconductive materials such as carbon blacks and ionic conductive materials is included in the intermediate transfer belt to control the resistivity thereof. The thickness of the intermediate transfer belt 41 is from 50 to 200 μm when a resin is used, and is from 300 to 700 μm when a rubber is used. A resin film on which a rubber layer is formed can also be used therefor. In addition, another layer can be formed as an outermost layer. Further, the transfer device can include an applicator configured to apply a lubricant or a release agent such as fluorine-containing resins to the surface of the intermediate transfer belt to improve the releasability and cleanability of the intermediate transfer belt (i.e., to prevent a toner from adhering to the intermediate transfer belt).

The driving roller 47 has a structure such that the peripheral surface of a metal shaft is covered with an electroconductive or semiconductive material, which includes a resin or a rubber (such as polyurethanes, EPDMs and silicones) and an electroconductive material (such as carbon blacks) dispersed in the resin or rubber.

The secondary transfer backup roller 46 and a secondary transfer roller 50, which is located outside of the loop of the intermediate transfer belt, sandwich the intermediate transfer belt 41, resulting in formation of a secondary transfer nip. As mentioned above, the pair of registration rollers 35, which have been sandwiching the receiving material sheet P, timely feed the sheet P toward the secondary transfer nip, at which the four color toner images over laid on the intermediate transfer belt 41 are transferred onto a proper position of the sheet P at the same time by the influence of a secondary transfer electric field formed between the secondary transfer roller 50 and the secondary transfer backup roller 46 and a nip pressure. Thus, a full color toner image is formed on the (white) receiving material sheet P.

The secondary transfer roller 50 has a structure such that an elastic layer is formed on a metal shaft (such as a stainless shaft) having a diameter of, for example, 16 mm. The elastic layer is made of a rubber (such as polyurethane, EPDM and silicone rubbers), which has a solid state or a foamed (sponge) state and which includes an electroconductive material (such as carbon blacks) or an ionic conductive material to have a volume resistivity of from about $10^5$ to about $10^9$ Ω·cm. The elastic layer has a thickness of about 7 mm, and an Asker-C hardness of from 20 to 70°. Since the secondary transfer roller 50 contacts residual toner particles on the intermediate transfer belt 41, the secondary transfer roller preferably has an outermost layer including a resin having a good combination of semiconductivity and releasability such as fluorine-containing resins and urethane resins.

After the intermediate transfer belt 41 passes the secondary transfer nip, toner particles, which are not transferred onto the receiving material sheet P, remain on the surface of the intermediate transfer belt 41. Such residual toner particles are removed therefrom by the belt cleaning unit 42. The belt cleaning unit includes a cleaning blade 42*a*, which is contacted with the image forming surface of the intermediate transfer belt 41 to scrape off the residual toner particles.

The first bracket 43 of the transfer unit 40 is rotated around the rotation axis of the support roller 48 at a predetermined angle by an ON/OFF driving operation of a solenoid (not shown). When a monochrome image (a black image) is formed in this printer, the first bracket 43 is slightly rotated counterclockwise by the solenoid. When the first bracket 43 is rotated, the yellow, cyan and magenta primary transfer rollers 45Y, 45C and 45M are counterclockwise rotated around the rotation axis of the support roller 48, thereby separating the intermediate transfer belt 41 from the photoreceptors 3Y, 3C and 3M. Therefore, among the four process units 1Y, 1C, 1M and 1K, only the process cartridge K is driven to operate, and thereby a black image is formed. By using this method, the process units 1Y, 1C and 1M are not wastefully operated in a black image forming operation. Therefore, exhaust of the process units can be prevented.

Referring to FIG. 1, a fixing unit 60 is provided over the secondary transfer nip. The fixing unit 60 includes a pressure and heat roller 61 including therein a heat source such as halogen heaters, and a fixing belt unit 62. The fixing belt unit 62 includes an endless fixing belt 64 serving as a fixing member, a heat roller 63 including therein a heat source such as halogen heaters, a tension roller 65, a driving roller 66, a temperature sensor (not shown), etc. The fixing belt 64 is allowed to make a counterclockwise endless movement by the heat roller 63, tension roller 65 and driving roller 66 while tightly stretched thereby. In this endless movement, the backside of the fixing belt 64 is heated by the heating roller 63. The pressure and heat roller 61, which is clockwise rotated, makes a pressure-contact with the fixing belt 64 at a location in which the fixing belt 64 is contacted with the heat roller 63, thereby forming a fixing nip.

A temperature sensor (not shown) is provided at a location just before the fixing nip so as to face the outer surface of the fixing belt 64 with a gap therebetween, to measure the temperature of the surface of the fixing belt. The temperature information is sent to a power supply circuit (not shown) of the fixing device. The power supply circuit performs an ON/OFF control operation on the power sources of the heat sources located in the heat roller 63 and the pressure and heat roller 61, and thereby the temperature of the surface of the fixing belt 64 is controlled to be about 140° C.

After passing the secondary transfer nip and separating from the intermediate transfer belt 41, the receiving material sheet P is fed to the fixing unit 60. When the receiving material sheet P passes through the fixing nip, the sheet P is heated and pressed by the fixing belt 64, thereby fixing the full color toner image on the sheet P.

The receiving material sheet P bearing the fixed full color toner image thereon is discharged from the printer by a pair of discharging rollers 67. The thus discharged sheet P is stacked on a stack portion 68.

As illustrated in FIG. 1, four toner cartridges 900Y, 900C, 900M and 900K respectively containing yellow, cyan, magenta and black color toners are arranged over the transfer unit 40. The color toners in the toner cartridges are appropriately supplied to the respective developing units 7Y, 7C, 7M and 7K. These toner cartridges can be detachably attached to the printer independently of the process units 1Y, 1C, 1M and 1K.

Referring to FIG. 2, the developing unit 7Y includes an initial developer container 17Y above the first developer container 9Y. The initial developer container 17Y is separated from the first developer container 9Y with a seal member 18Y. The seal member 18Y is manually removed from the developing unit 7Y by a user. When a new one of the developing unit 7Y is shipped from a factory, the developing unit contains an initial yellow developer, which contains a yellow toner at a concentration of 5% by weight, in the initial developer container 17Y thereof. When the developing unit is set in the printer, the seal member 18Y is manually removed from the developing unit 7Y by a user. The Initial yellow developer is fed into the first developer contained 9Y by the weight thereof.

Whenever a new one of the printer is set and initially operated after shipment or a new one of the developing unit 7 is set in the printer, the printer performs an initial developer supply judgment processing just after the setting. This initial developer supply judgment processing is started when the user performs key-inputting after removing the seal member 18 using a display, a keyboard or the like of the printer. When the key-inputting operation is performed, the controller of the printer rotates the first and second feeding screws 8 and 11. Next, the toner concentration sensor 10 measures the toner concentration of the developer, and the controller determines whether the initial developer is properly set in the second developer container 14Y on the basis of the toner concentration information.

Figure 5:
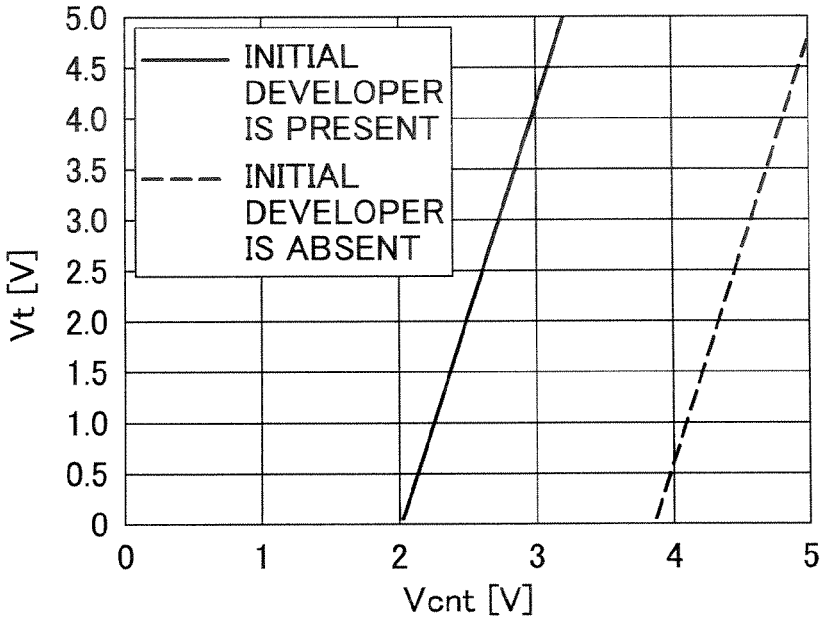
FIG. 5 is a graph showing the property of a high sensitivity toner concentration sensor, in which the relationship between the level adjust voltage Vcnt [V] input thereto and the output voltage Vt [V] output therefrom is illustrated.

The present printer uses a high sensitive sensor for each of the toner concentration sensors 10. FIG. 5 is a graph illustrating the property of the sensor, i.e., a relationship between the level adjustment voltage Vcnt (V) input thereto and the output voltage Vt (V) output therefrom. The solid line represents the Vcnt-Vt relationship in a case where the initial developer is present in the second developer container 14, and the dotted line represents the Vcnt-Vt relationship when the initial developer is not present in the second developer container 14. For example, when the initial developer is present in the second developer container and a level adjustment voltage Vcnt of about 2.8 V is input to the sensor, the sensor outputs a voltage Vt of about 3 V. In contrast, when the initial developer is not present in the second developer container and a level adjustment voltage Vcnt of about 2.8 V is input to the sensor, the sensor hardly outputs a voltage Vt. Therefore, if a level adjustment voltage Vcnt of about 2.8 V is applied to this sensor and the output voltage Vt from the sensor is less than 3 V, it can be determined that the initial developer is not present in the second developer container 14.

However, if the level adjustment voltage Vcnt is set to about 2.8 V, a misjudgment problem tends to be caused in a case where a small amount of initial developer is present in the second developer container. Therefore, in order to prevent occurrence of such a misjudgment problem, the level adjustment voltage Vcnt is typically set to a voltage near the upper limit thereof. In this toner concentration sensor, the upper limit of the level adjustment voltage Vcnt is 5 V. Therefore, a voltage of about 4.5 V is applied as the level adjustment voltage Vcnt. In this case, as illustrated by the dotted line in FIG. 5, a voltage of about 2.6 V is output from the sensor as the output voltage Vt.

Popular magnetic permeability sensors with a sensitivity lower than that of high sensitive sensors have smaller sensitivity variation (i.e., variation in the horizontal axis direction in FIG. 5) than the high sensitive sensors. Therefore, for example, when a voltage of 4.5 V is applied as the level adjustment voltage Vcnt and the resultant output voltage Vt is less than 0.5 V, it can be determined without any trouble that the initial developer is not present or a small amount of initial developer is present in the second developer container. Namely, when a low sensitive sensor having such a sensitivity variation is used, whether or not the initial developer is present in the second developer container can be determined without any trouble if the threshold output voltage is set to 0.5 V.

However, as a result of an experiment of the present inventors, it is discovered that high sensitivity sensors have a property such that variation in sensitivity among the same sensors is larger that that in the case of low sensitivity sensors, and therefore the threshold output voltage cannot be set to a certain voltage.

Next, the feature of the printer of the present invention will be explained.

Referring to FIG. 4, a memory circuit board 19Y is provided on a casing of the yellow developing unit 7Y. The memory circuit board 19Y includes a nonvolatile memory chip (not shown) such as nonvolatile RAMs. The memory chip stores information on the characteristics of the yellow toner concentration sensor 10Y. Specifically, the memory chip stores a blank reference voltage Vt_0*a*, which is a first reference voltage of the output voltage Vt from the toner concentration sensor. In addition, the memory chip also stores an initial developer reference voltage Vt_0*b*, which is a second reference voltage of the output voltage Vt from the toner concentration sensor. Thus, the memory chip serves as a storage device for storing the characteristic information of the yellow toner concentration sensor 10Y. Needless to say, similar memory circuit boards are provided on the cyan, magenta and black developing units 7C, 7M and 7K.

The blank reference voltage Vt_0*a* is set to a level adjustment voltage Vcnt slightly higher than the output voltage Vt output by the toner concentration sensor 10Y when a magnetic material is not present within a magnetic permeability sensing range of the sensor, and a level adjustment voltage Vcnt of 4.5 V is input to the sensor. This blank reference voltage Vt_0*a* is determined for each of the sensors in a factory before shipment of the developing device or the printer.

The initial developer reference voltage Vt_0*b* is set to a voltage which is equal to the output voltage Vt from the toner concentration sensor when the magnetic permeability of a reference magnetic material, which is the same as the magnetic permeability of the initial developer including a toner in an amount of 5% by weight is measured by the sensor to which a level adjustment voltage Vcnt of 4.5 V is input. This initial developer reference voltage is also determined for each of the sensors in a factory before shipment of the developing device or the printer.

In addition, the sensitivity characteristic of each of the sensors is also determined before shipment of the developing device or the printer. Specifically, the sensitivity is a slope (a) of a relationship ($Vt=a\times Vcnt+b$) between the level adjustment voltage Vcnt and the output voltage Vt of the sensor when the magnetic permeability of a reference magnetic material having the same magnetic permeability as that of the initial developer Including a toner in an amount of 5% by weight is measured by the sensor. This sensitivity information is also determined for each of the sensors before shipment of the developing device or the printer.

As mentioned above, each of the process units 1 stores the blank reference voltage in the memory chip of the memory circuit board 19 thereof. Therefore, when a user performs an initial driving operation on the developing unit 7 while the initial developer is not present in the secondary developer container 14 thereof, the output voltage Vt output from the toner concentration sensor should be less than the black reference voltage Vt_0*a*. However, depending on various variables, there is a possibility that the blank reference voltage set in the factory is not identical to that at the user side. For example, it is possible that a metal plate or another magnetic member located in the vicinity of the toner concentration sensor of the printer set in the user's office influences the blank reference voltage Vt_0*a*.

In addition, the agitation speed of the second feeding screw 11 influences the toner concentration detection result. Specifically, the higher the agitation speed, the lower the output voltage Vt, because a larger amount of air is included in the developer (i.e., in the toner particles and carrier particles). When the initial developer is not present in the second developer container 14, the agitation speed does not influence the detection result. However, even when a small amount of initial developer is set in the second developer container, the agitation speed influences the detection result. Therefore, in order that the sensor determines that the initial developer is not present in the second developer container even in a case where a part of the initial developer is contained in the second developer container, the agitation speed of the second feeding screw has to be considered. In this regard, if the agitation speed is within the predetermined range, the agitation speed hardly influences the detection result. However, there is a case where the agitation speed largely changes. For example, there is a case where the gear ratio of the feeding screw is changed when the developing roller is remodeled. In this case, the agitation speed of the second feeding screw of the new developing device is different from that of the old developing device. Therefore, the blank reference voltage Vt_0*a* for the new developing device is set to an improper value.

In addition, the level adjustment voltage Vcnt applied to the toner concentration sensor often changes depending on the printer to which the sensor is set. For example, there is a case where although a printer performs a controlling operation of applying a level adjustment voltage Vcnt of 4.5 V, in reality a level adjustment voltage of 4.2 V is applied to the toner concentration sensor. In this case, the blank reference voltage Vt_0*a* set for the printer is different from the proper blank reference voltage for the printer. Similarly to the blank reference voltage, which is explained above, the initial developer reference voltage set for the printer can also be different from the proper initial developer reference voltage for the printer.

In order to prevent occurrence of such a problem, the controller of this printer performs the following controlling operation. Specifically, when the controller reads the blank reference voltage information stored in the memory chip of the memory circuit board 19, the controller corrects the stored blank reference voltage Vt_0*a* and uses the corrected blank reference voltage for determining whether or not the initial developer is present in the second developer container. More specifically, the blank reference voltage Vt_0*a* read from the memory chip is corrected using the following equation (1):

$$Vt_0a\ (\text{corrected})=Vt_0a\ (\text{stored})\times\alpha+\beta \qquad \text{(equation 1)},$$

wherein each of α and β is a constant, which is determined by performing a preliminary experiment.

The controller stores the corrected Vt_0*a* in a storage device (such as RAMs) thereof.

In addition, when the controller reads the initial developer reference voltage Vt_0*b* stored in the memory chip of the memory circuit board 19, the controller corrects the stored initial developer reference voltage and uses the corrected reference voltage for the initial developer output adjustment processing mentioned below. Specifically, the initial developer reference voltage Vt_0*b* read from the memory chip is corrected using the following equation (2):

$$Vt_0b\ (\text{corrected})=Vt_0b\ (\text{stored})\times\gamma+k \qquad \text{(equation 2)}$$

wherein each of γ and k is a constant, which is determined by performing a preliminary experiment.

The controller stores the corrected Vt_0*b* in a storage device (such as RAMs) thereof.

Figure 6:
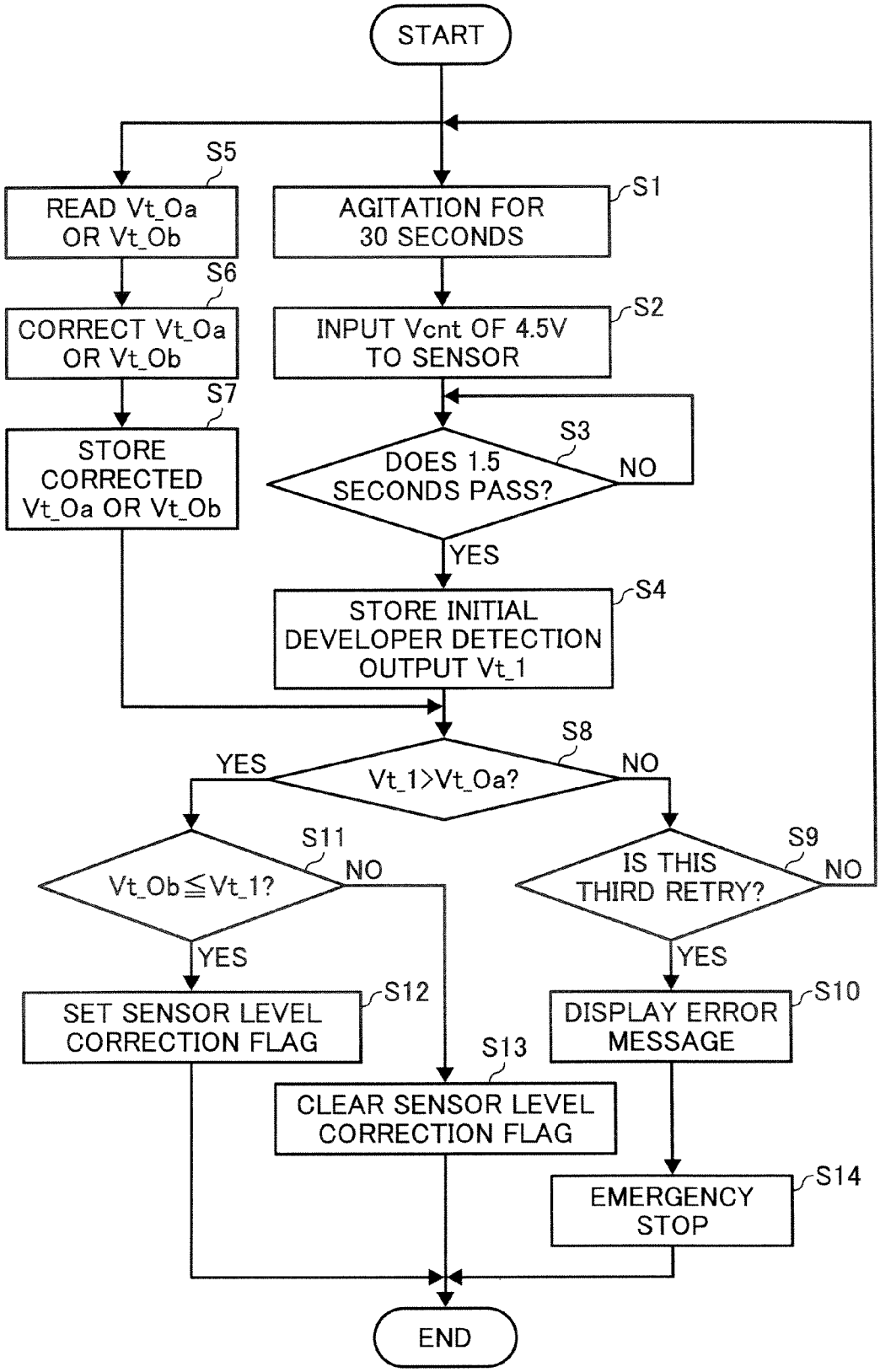
FIG. 6 is a flowchart of the initial developer supply judgment processing of the controller of the printer illustrated in FIG. 1.

FIG. 6 is a flowchart of the initial developer supply judgment processing of the controller of the printer illustrated in FIG. 1. Prior to the initial developer supply judgment processing, the controller performs a developing unit replacement confirmation operation. Specifically, the memory circuit board 19 stores a developing unit ID, which is information specific to the developing unit, as well as the characteristics of the toner concentration sensor. The developing unit ID is a number or the like specific to the developing unit. When the developing unit is replaced, the developing unit ID stored in the memory chip is changed. In this case, the controller displays a message "Please pull out the sealing member of the developing unit and push the OK button" in the operation panel (not shown). When a user performs the directed operations, the controller performs the initial developer supply judgment processing.

Next, the initial developer supply judgment processing is explained referring to FIG. 6. At first, an agitation operation (such as rotation of the first and second feeding screws) is performed for 30 seconds (Step 1). The agitation time can be changed by performing keyboard inputting using the operation panel. After the 30-second agitation operation, a level adjustment voltage Vcnt of 4.5 V is applied to the toner concentration sensor of the newly set developing device (Step 2). When 1.5 seconds pass after the voltage application (Yes in Step 3), the controller obtains the information on the output voltage Vt output from the toner concentration sensor, and stores the voltage in the nonvolatile RAM of the controller as the initial developer detection output voltage Vt_1 (Step 4).

In parallel with the above-mentioned operations, correction of the blank reference voltage Vt_0*a* and the initial developer reference voltage Vt_0*b* is performed. Specifically, at first the controller reads the information on the blank reference voltage Vt_0*a* and the initial developer reference voltage Vt_0*b* stored in the memory chip in the memory circuit board of the newly set developing unit (Step 5). The controller then corrects the blank reference voltage Vt_0*a* and the initial developer reference voltage Vt_0*b* using the above-mentioned correction equations and stores the corrected values in the RAM thereof (Step 6 and Step 7)

In this regard, the values of the blank reference voltage Vt_0*a* and the corrected blank reference voltage Vt_0*a* stored in the memory chip are specific to the toner sensor of the newly set developing device. In addition, the values of the initial developer reference voltage Vt_0*b* and the corrected initial developer reference voltage Vt_0*b* stored in the memory chip are also specific to the toner sensor of the newly set developing device. Therefore, even when the sensor has a large individual variation in the characteristics, it can be determined without any trouble that the initial developer is present, if the output voltage Vt from the toner concentration sensor is greater than the corrected blank reference voltage Vt_0*a*. In other words, when the output voltage Vt is not greater than the corrected blank reference voltage Vt_0*a*, it can be determined without any trouble that the initial developer is not present or a small amount of initial developer is present in the second developer container. When it is determined that the initial developer is present and in addition the output voltage Vt is not less than the corrected initial developer reference voltage Vt_0*b*, it can be determined without any trouble that the developer in the second developer container is the initial developer. In other words, when the output voltage is less than the corrected initial developer reference voltage Vt_0*b*, the developer contained in the second developer container is not the initial developer, which includes a toner in an amount of 5% by weight, and is a developer including a toner in an amount of greater than 5% by weight.

Therefore, in Step 8 the controller determines whether the initial developer detection output voltage Vt_1 stored in Step 4 is greater than the corrected blank reference voltage Vt_0*a* (hereinafter referred to as a developer presence/absence judgment processing). If Vt_1 is not greater than Vt_0*a* (i.e., No in Step 8), the controller judges that the initial developer is not present, and the operations of Steps 1-4 and Steps 5-7 are re-executed. When the re-execution is the third re-execution (i.e., Yes in Step 9), the controller displays an error message such as "The initial developer is not set" in the operation panel (Step 10) and then performs an emergency stop operation on the printer (Step 14).

If Vt_1 is greater than Vt_0*a* (i.e., Yes in Step 8), the controller judges that the initial developer is present in the second developer container, and the controller performs the following operations. Specifically, the controller judges whether or not the initial developer detection output voltage Vt_1 is not less than the corrected initial developer reference voltage Vt_0*b* (Step 11). When Vt_0*b*≦Vt_1, the controller determines that the developer in the second developer container is the initial developer including a toner in an amount of 5% by weight. When Vt_0*b*>Vt_1, the controller determines that the developer in the second developer container is a developer including a toner in an amount of greater than 5% by weight.

When Vt_0*b*≦Vt_1 (i.e., Yes in Step 11), the controller sets a sensor level correction flag (Step 12). When Vt_0*b*>Vt_1 (i.e., No in Step 11), the controller clears the sensor level correction flag (Step 13). The sensor level correction flag will be explained later.

The present inventors tested three pieces of the same high sensitive sensor A, B and C for the black toner concentration sensor 10K. Specifically, in a test 1 (i.e., a delivery inspection), a level adjustment voltage Vcnt of 4.5 V was applied to the three sensors A, B and C to measure the blank reference voltage Vt_0 of each of the sensors. In this regard, no magnetic material was present at a location within the magnetic permeability detectable range of the sensors. In a test 2, each of the sensors A, B and C was alternately set in the black developing unit of a test printer having the same configuration as the printer illustrated in FIG. 1, and the information on the blank reference voltage Vt_0 of each of the sensors was stored in the memory chip of the memory circuit board of the black developing unit. The test printer was then operated while the initial developer was not fed to the developing unit to determine whether the initial developer supply judgment processing illustrated in FIG. 6 can be properly performed. In this regard, the blank reference voltage Vt_0*a* is corrected using the above-mentioned equation (1), wherein α is 1.045, and β is 0.35. The constants α and β had been determined by performing a preliminary experiment. The results are shown in Table 1.

TABLE 1

| | Test 1 | | | Test 2 | | |
|---|---|---|---|---|---|---|
| Sensor | Vcnt (V) | Vt_0a | Corrected Vt_0a | Vcnt (V) | Vt_1 | Check of judgment |
| A | 4.49 | 0.70 | 1.08 | 4.50 | 0.51 | OK |
| B | 4.50 | 1.20 | 1.60 | 4.51 | 1.05 | OK |
| C | 4.50 | 0.50 | 0.87 | 4.50 | 0.30 | OK |

As illustrated in Table 1, the blank reference voltages of the sensors A, B and C in the test 1 were 0.70 V, 1.20 and 0.50, respectively. Thus, this high sensitive sensor has a large individual variation in the characteristic (Vt_0*a*).

The corrected Vt_0*a* of the sensor A is 1.08 (=0.70×1.045+0.35) In contrast, the initial developer detection output voltage Vt_1 of the sensor A in the test 2 is 0.51 V. In this regard, the relationship Vt_1>Vt_0*a* in Step 8 of FIG. 6 is not satisfied, and therefore a proper judgment such that the initial developer is not present is made from the corrected Vt_0*a*. Thus, the controller can make a proper judgment on the basis of the information from the sensor A. Similarly, a proper judgment can be made for the sensors B and C on the basis of the information sent from the sensors. Thus, the printer of the present invention can prevent occurrence of a misjudgment problem.

Figure 7:
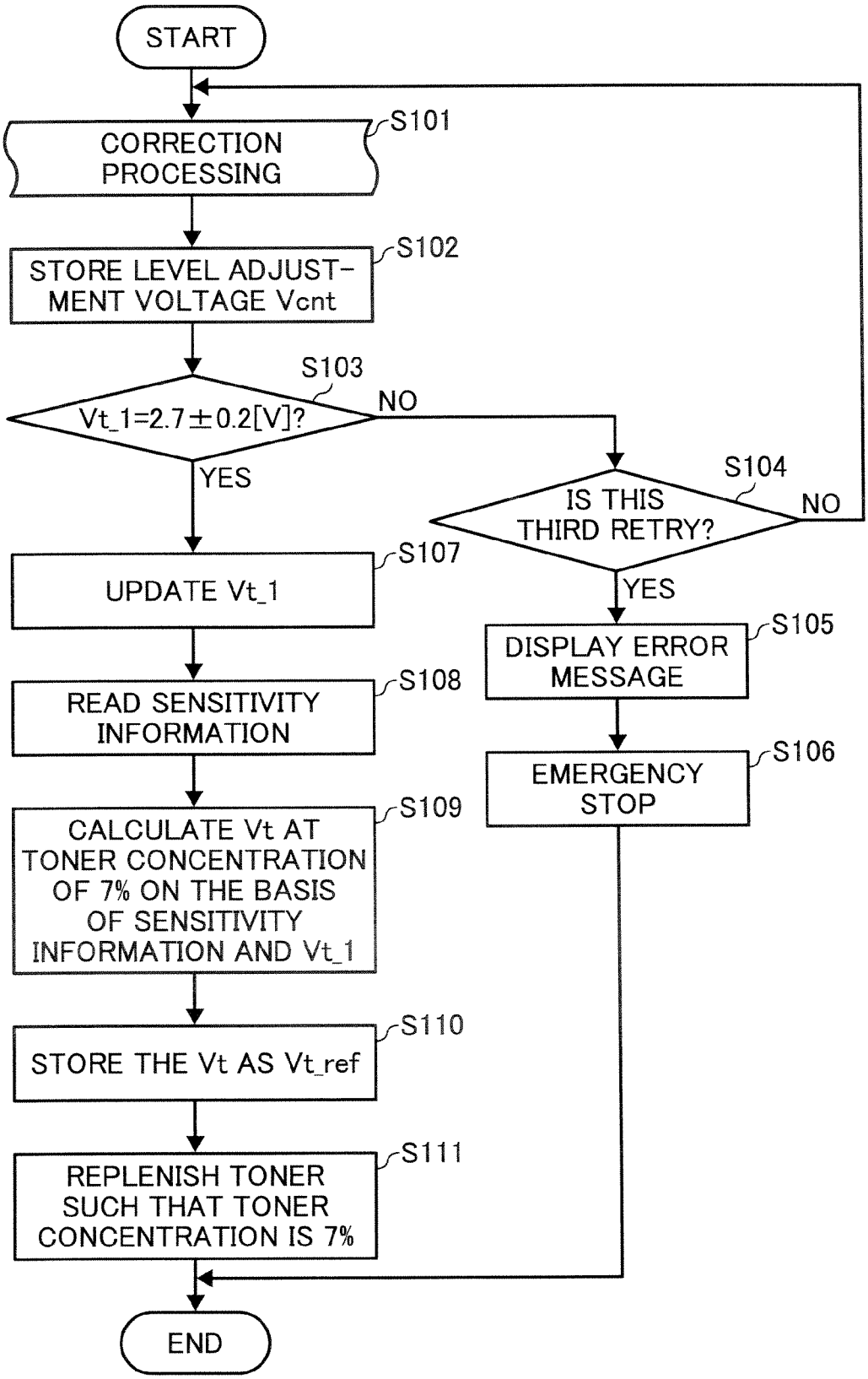
FIG. 7 is a flowchart of the output adjustment processing of the controller when presence of the initial developer is detected.

FIG. 7 is a flowchart of the output adjust processing of the controller when it is determined that the initial developer is present. In this output adjust processing, the output level of the toner concentration sensor of the newly set developing unit is adjusted. This output adjustment processing follows the initial developer supply judgment processing mentioned above by reference to FIG. 6. However, when the sensor level correction flag is cleared (Step 13), this output adjust processing is not performed. Namely, in the present printer, even when it is judged in the initial developer supply judgment processing that the developer is properly set, the output adjustment processing illustrated in FIG. 7 is not performed if it is judged that the developer is not the initial developer including a toner in an amount of 5% by weight, and is a developer including a toner in an amount of greater than 5% by weight.

The output adjustment processing will be explained by reference to FIG. 7. At first, in order that the output voltage Vt_1, which is an output signal from the toner concentration sensor, falls in a predetermined range, a correction processing, in which the level adjustment voltage Vcnt (i.e., level adjustment signal) is adjusted, is performed (Step 101). In this correction processing, the level adjustment voltage Vcnt is adjusted such that the output voltage Vt_1 from the sensor falls in a range of ±0.2 V of the predetermined reference output voltage (2.7 V in this example), which is stored in the RAM of the controller.

More specifically, in the initial developer supply judgment processing illustrated in FIG. 6, the level adjustment voltage Vcnt is set to 4.5 V. However, in the output adjustment processing illustrated in FIG. 7, the level adjustment voltage Vcnt is changed by binary search. The half value increase/decrease method is such that the level adjustment voltage Vcnt is changed by half the voltage Vcnt on the basis of the output voltage Vt_1 output from the toner concentration sensor. Specifically, since the level adjustment voltage Vcnt is 4.5 V before the output adjustment processing, the level adjustment voltage is changed by 2.25 V (4.5/2) when the output adjustment processing starts. After the output adjustment processing is performed, the output voltage Vt_1 from the toner concentration sensor is checked to determine whether the output voltage falls in the range of 2.7±0.2 V. If the output voltage is lower than the range, the level adjustment voltage Vcnt is changed from 2.25 V to 3.375 V (=2.25+2.25/2) and the output voltage is checked again. If the output voltage is higher than the range, the level adjustment voltage Vcnt is changed from 2.25 V to 1.125 V (=2.25−2.25/2) and the output voltage is checked again. By performing this correction processing nine times, the output voltage Vt_1 is controlled so as to fall in the reference output range (2.7±0.2 V).

When measuring the initial developer detection output voltage Vt_1, sampling is performed plural times to obtain the average of the plural output voltage data. The average is compared with the reference output voltage (2.7 V). In this regards the time (S) needed for one sampling operation is obtained by the following equation:

$$S\,[\text{msec}]=T1+Tm$$

wherein T1 represents the time between change of the level adjustment voltage Vcnt and stabilization of the data sent from the toner concentration sensor and is 1.5 seconds in this example, and Tm represents the time needed for measurement of the output voltage.

The number of the sampling operations is determined on the basis of the rotation number of the second feeding screw, which influences the state of the toner dispersed in the developer. Specifically, in this example, the sampling time T during which the sampling operation is performed plural times is set as follows.

$$T\,[\text{msec}]=(60/V_2)\times N\times 1000$$

wherein $V_2$ represents the rotation speed of the second feeding screw, N represents the number of rotation of the screw needed for well agitating the developer.

When the level adjustment voltage Vcnt is changed, sampling of the output voltage Vt_1 is performed by T/S times. The average of the output voltage is compared with the reference output (2.7 V).

When the correction processing is completed, the final level adjustment voltage Vcnt is stored in the RAM (Step 102). Next, whether the resultant initial developer detection output voltage Vt_1 falls in the reference output voltage range (2.7 V±0.2 V) is determined (Step 103). If the output voltage Vt_1 is out of the range (No in Step 103), the control operation is returned to Step 101. If the reexecution (retry) is the third reexecution (Yes in Step 104), the controller displays an error message (such as "sensor error") in the operation panel (Step 105) because it is considered that the sensor has a bad electrical contact or the sensor itself is abnormal. Then the controller allows the printer to make an emergency stop (Step 106).

When the output voltage Vt_1 falls in the reference output voltage range (2.7 V±0.2 V) (Yes in Step 103), the data of the output voltage Vt_1 stored in the RAM are replaced with the new data (Step 107), and then the sensitivity information on the sensor stored in the memory chip of the memory circuit board is read (Step 108). Next, on the basis of the sensitivity information and the output voltage Vt_1, the output voltage from the sensor is calculated assuming that the toner concentration is increased from 5% to 7% (Step 109). The thus determined data of the output voltage Vt_1 are stored in the RAM of the controller as the target output voltage Vt_ref of the output voltage Vt_1 (Step 110). After the target output voltage Vt_ref is determined, the controller drives the toner supplying device to supply the toner to the newly set developing unit so that the concentration of the toner in the developer in the developing unit increases to 7% (Step 111).

As mentioned above, when the developing unit is replaced, the toner concentration sensor is corrected and then the toner concentration is increased from 5% to 7%. Subsequently, printing operations are performed. The reason why the concentration of toner in the initial developer is controlled so as to be 7% by weight is as follows. Specifically, since the toner in the initial developer is not subjected to frictional charging, a toner scattering problem is easily caused during the initial agitation process. If the initial developer contains the toner in an amount of 7% at which the printing operations are performed, the amount of the scattered toner increases in the agitation process. Therefore, the toner concentration is controlled to be 5% by weight to avoid the toner scattering problem.

As mentioned above, if the concentration of toner in the developer set in the second developer container is judged to be greater than that (i.e., 5%) of the initial developer, the initial developer output adjustment processing illustrated in FIG. 7 is not performed. The reason therefor is as follows. In this printer, whether or not the developing device is replaced is determined on the basis of the developing unit ID stored in the memory chip. When it is determined that the developing device is replaced, the initial developer supply judgment processing (illustrated in FIG. 6) and the initial developer output adjustment processing (illustrated in FIG. 7) are performed. In this regard, the newly set developing device is not necessarily a new developing device, and may be a used developing unit.

If a used developing unit, which typically includes a toner in an amount of 7%, is set and the above-mentioned initial developer output adjustment processing is performed, the following problem will occur. Specifically, when the initial developer output adjustment processing is performed, the output voltage Vt for the developer containing the toner in an amount of 7% becomes the target output voltage Vt_ref. Therefore, the Vt_ref is set to a voltage lower than the proper target output voltage. Accordingly, the toner concentration is controlled so as to be greater than 7% during the printing operations, resulting in occurrence of problems such that the toner images have too high image density and the toner in the developer scatters.

Therefore, this printer judges whether the developer set in the second developer container is the initial developer or a developer containing a toner at a higher concentration on the basis of the initial developer reference voltage Vt_0*b* and the output voltage output from the toner concentration sensor in the initial developer supply judgment processing. When it is judged that a developer containing a toner at a higher concentration is set, the initial developer output adjustment processing is not performed. Therefore, the printer can prevent occurrence of the high image density problem and the toner scattering problem even when a used developing unit is set.

Figure 8:
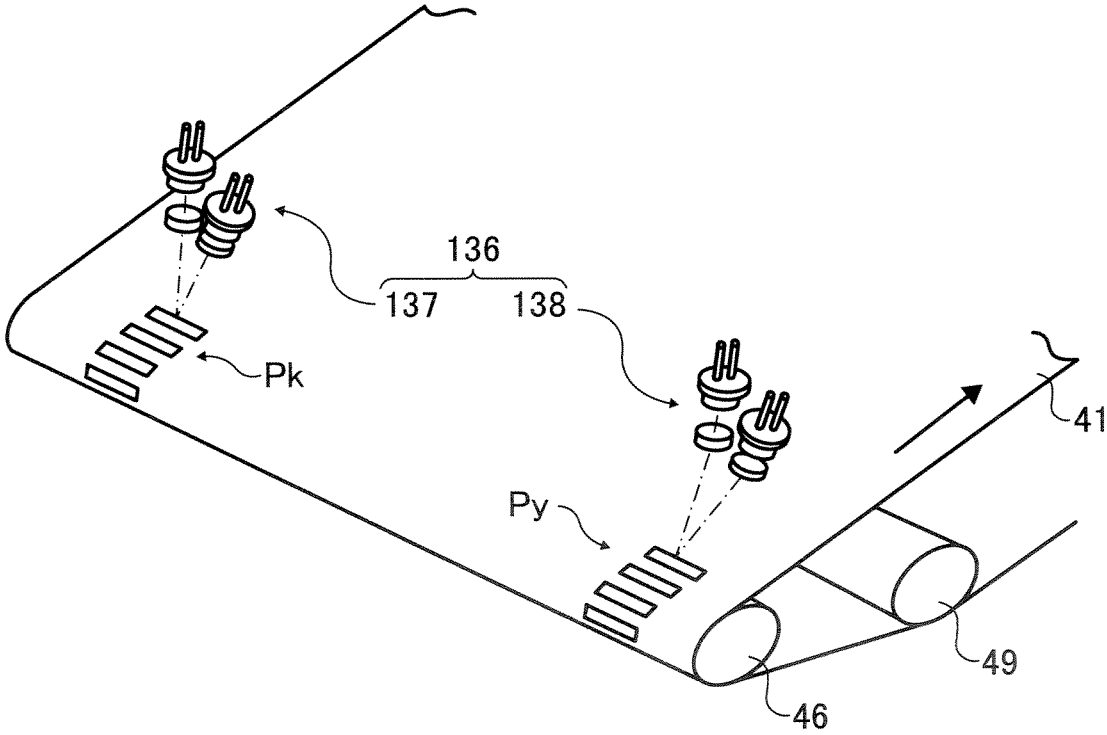
FIG. 8 is a schematic perspective view illustrating the intermediate transfer medium and optical sensor units of the printer illustrated in FIG. 1.

FIG. 8 is a schematic perspective view illustrating a part of the intermediate transfer medium 41 and optical sensor units 136 of the printer illustrated in FIG. 1.

The controller of this printer performs a self-check operation just after a power switch (not shown) is turned on or at regular intervals. In this self-check operation, a black gradation image Pk including plural black half tone images (i.e., reference black patches) is formed on one side of the intermediate transfer medium 41, and a yellow gradation image Py including plural yellow half tone images (i.e., reference yellow patches) is formed on the other side of the intermediate transfer medium 41. In addition, although not shown in FIG.

8, plural cyan half tone images and plural magenta half tone images are formed after the plural yellow half tone images.

Referring to FIG. 8, a first optical sensor 137 and a second optical sensor 138 are provided above the intermediate transfer belt 41. In the first optical sensor 137, a light source emits a light beam so that the light beam passes through a condenser lens and irradiates the surface of the intermediate transfer belt 41. The light beam, which is reflected from the surface of the intermediate transfer belt, is received by a receiving member of the sensor 137. The sensor outputs a voltage depending on the light quantity of the received light beam. When the reference black patches pass under the sensor 137, the light quantity of the received light beam is largely changed. Therefore, the sensor 137 outputs voltages corresponding to the image densities (i.e., the weight of toner per unit area) of the reference black patches. In this regard, LEDs, which can emit light beams with light quantity sufficient to detect the toner images, are typically used as the light source. In addition, CCDs, in which a number of light receiving elements are linearly arranged, are typically used as the light receiving member. Similarly, the second optical sensor 138 outputs voltages corresponding to the image densities (i.e., the weight of toner per unit area) of the reference yellow patches.

Figure 9A:
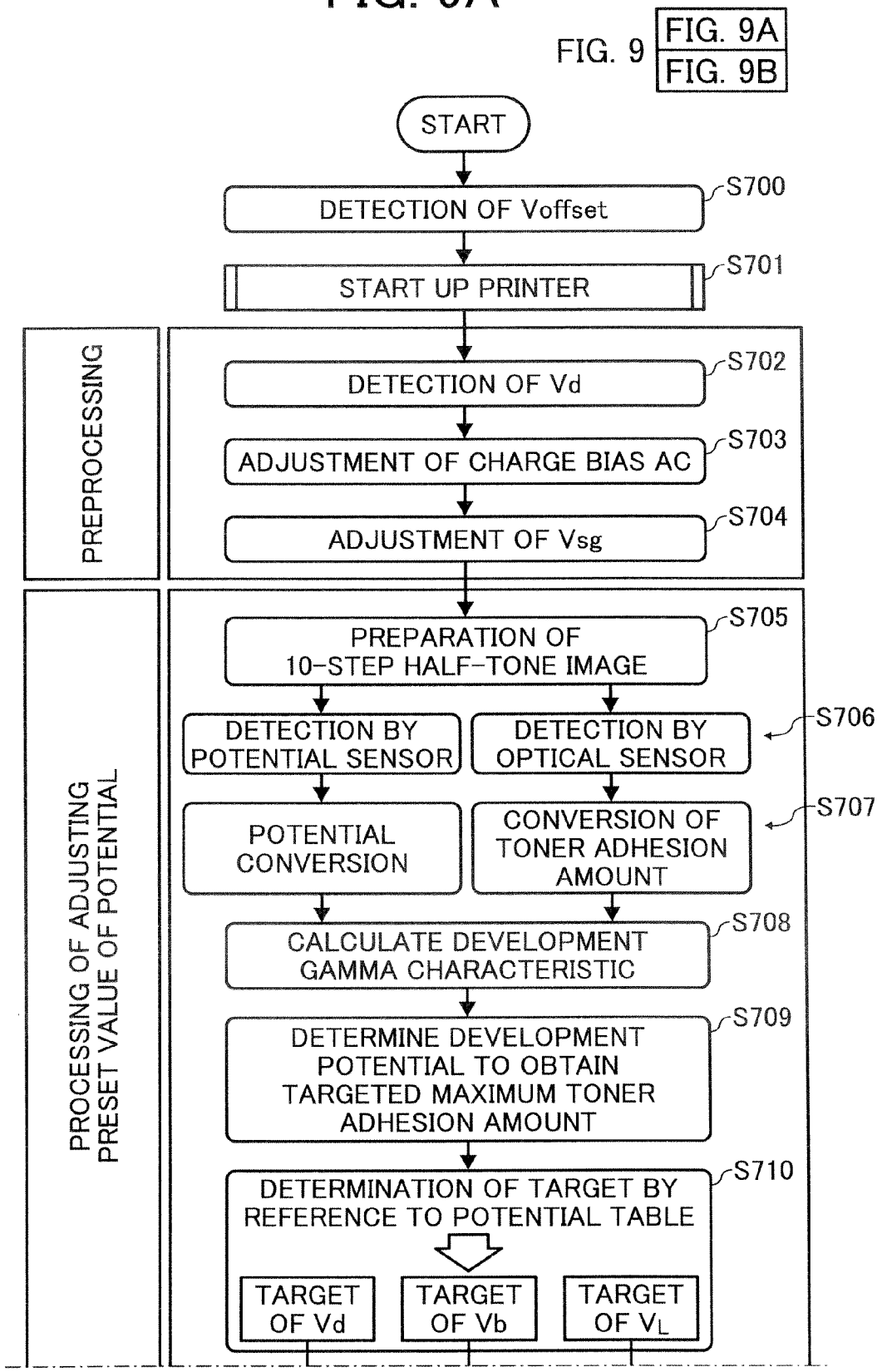
FIG. 9 is a flowchart of the self-check operation of the controller of the printer illustrated in FIG. 1.
Figure 9B:
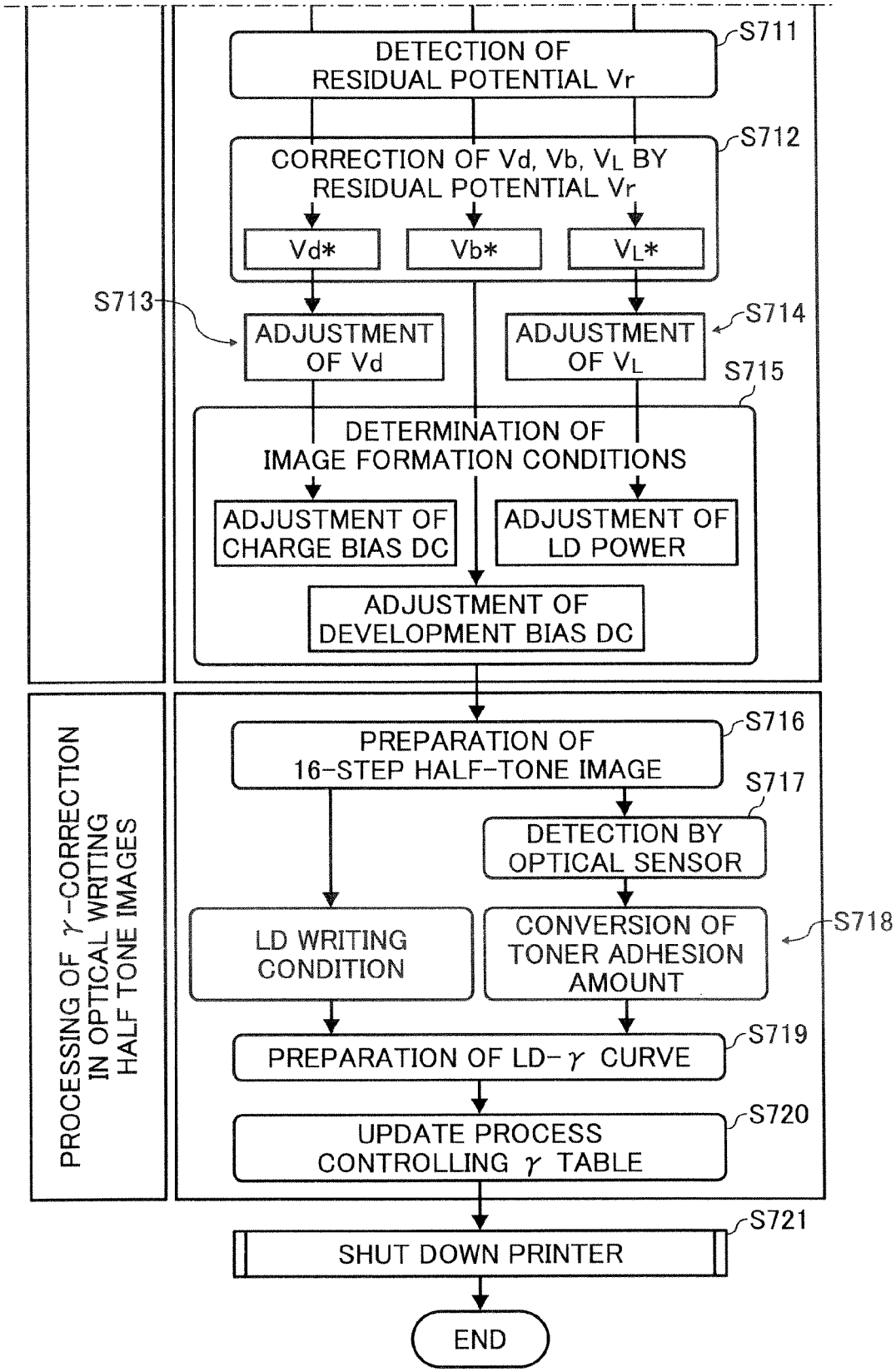

FIG. 9 is a flowchart of the self-check operation of the controller of the printer illustrated in FIG. 1.

In the self-check operation, at first the temperature of surface of the fixing belt 64 of the fixing unit 60 is measured to distinguish the start state (i.e., power-ON state) of the fixing unit from an abnormal state such as jamming of a receiving material sheet. Specifically, it is determined whether or not the surface temperature is higher than 100° C. When the temperature is higher than 100° C., the self-check operation is not performed. When the temperature is not higher than 100° C., the self-check operation is performed. Namely, the controller judges whether the temperature condition (i.e., the temperature is not higher than 100° C.) is satisfied (i.e., whether the printer is in a start state), and performs the self-check operation if the condition is satisfied.

Next, the output voltages (Voffset) of the sensors 137 and 138 are measured while the light sources (LED) thereof are turned off (Step 700). Then the start-up operation of the printer is performed (Step 701). In this start-up operation, motors of the photoreceptor drums, motors of the intermediate transfer belt, and motors for secondary transfer are activated. In addition, start-up operations for charge bias, development bias and transfer bias are performed so that proper biases can be applied at predetermined timing. When driving of the intermediate transfer belt 41 is started by activating the motor therefor, the light sources (LED) of the optical sensors are also turned on.

Subsequently, the surface potential Vd of each of the charged photoreceptors, which are charged under the predetermined conditions, is measured with a potential sensor (not shown) (Step 702), and the charge bias of the charging device 5 is adjusted depending on the detected surface potential (Step 703). Next, a Vsg adjustment operation is performed (Step 704). In this Vsg adjustment operation, the light quantity of the light source (LED) is adjusted such that the output voltage Vsg_reg of the optical sensors receiving light from a non-image area of the intermediate transfer belt 41 falls in a predetermined range (for example, 4.0±0.2 V). The thus adjusted output voltage Vsg_reg is stored in the RAM. The operations in Steps 702 and 703 are performed in parallel on the four process units 1. In addition, the operation in Step 704 is performed in parallel on the two optical sensors 137 and 138.

After performing the pre-processing mentioned above, a processing of adjusting the preset value of potential is performed. Specifically, a Y-10 yellow half tone image (Py) having 10 yellow half tone patches, a C-10 cyan half tone image (Pc) having 10 cyan half tone patches, a M-10 magenta half tone image (Pm) having 10 magenta half tone patches, and a K-10 black half tone image (Pm) having 10 black half tone patches are formed (Step 705). These half tone images are detected with the two optical sensors which are arranged so as to be apart from each other by 40 mm (Step 706) The output voltages from the two sensors are stored in the PAM as K-Vsp_reg-i, Y-Vsp_reg-i, C-Vsp_reg-i, and M-Vsp_reg-i, wherein i is an integer of from 1 to 10. At the same time, the potentials of the electrostatic half tone images formed on the photoreceptor drums are measured with the potential sensor, and the output voltages therefrom are also stored in the RAM. In this regard, each patch has a size of 15 mm×20 mm, and the interval between two adjacent patches is 10 mm.

Next, the development potential is calculated from the output voltage from the potential sensor and the development bias applied when the half tone patches are formed (Step 707). At the same time, the amount of the toner adhered to each of the half tone patches is calculated using an adhered toner calculation algorithm. In this regard, two algorithms are used, one of which is used for the black toner images and the other of which is used for the yellow, cyan and magenta toner images.

Then the development gamma characteristics γ of the developers are determined (Step 708). Specifically, a collinear approximation equation representing the relationship between the development potentials of the patches and the amounts of the toner adhered to the patches is obtained to obtain the slope (i.e., the development gamma characteristic γ) of the collinear approximation line and the intercept (i.e., the development starting potential) between the X-axis and the collinear approximation line.

After calculation of the development gamma characteristics, the optimum development potential is determined to produce toner images having a targeted amount of toner (Step 709). In addition, potentials Vd of the photoreceptordrums, development biases Vb, intensity $V_L$ of light used for forming electrostatic images are determined on the basis of the potential tables stored in the RAM (Step 710). In this case, it is possible that the concentration of toner in the developers is deviated from the optimum concentration. Specifically, the magnetic permeability of a developer changes depending on not only the toner concentration but also the environmental conditions such as humidity. Therefore, even when the toner replenishing operation is performed in order that the output voltage from the toner concentration sensor approaches the target output voltage Vt_ref, the image density of produced images varies. Therefore, in this printer the controller corrects the target output voltage Vt_ref on the basis of the information on the sensitivity of the toner concentration sensor stored in the memory chip of the memory circuit board, the development gamma characteristic and the amount of toner adhered to the predetermined half tone image (i.e., the image density of the predetermined half tone image (patch)). Then the potentials Vd of the photoreceptor drums, development biases Vb, intensity $V_L$ of light used for forming electrostatic images are determined on the basis of the thus corrected target output voltage Vt_ref by reference to the potential table.

Next, the controller controls the laser diode via a laser control circuit (not shown), which controls the optical writing unit 20, so that the quantity of light emitted by the laser diode is maximized. The output voltage of the potential sensor is checked to determine the residual potential of each photoreceptor drum (Step 711). When the residual potential is not 0, the potentials Vd, Vb and $V_L$ determined in Step 710 are corrected by the residual potential to determine the targeted potentials Vd*, Vb* and $V_L$* (Step 712).

Then the powers of the power circuits (not shown) used for the charging devices of the process units 1 are adjusted in parallel so that the potentials of the charged photoreceptors approach the targeted potentials Vd* (Step 713), and in addition the powers of the laser diodes used for writing electrostatic images are adjusted through the laser controlling circuit so that the surface potentials $V_L$ approach the above-mentioned targeted surface potentials $V_L$* (Step 714). Further, the powers of the power circuits used for applying the development potentials are adjusted in parallel so that the development biases Vb approach the targeted development biases Vb*. The thus adjusted potentials Vd, $V_L$ and Vb are stored as the image forming conditions under which image formation is performed (Step 715). Thus, the above-mentioned processing of adjusting the preset values of potentials is performed to produce images having solid color images with targeted image densities.

After the processing, a processing of γ-correction in optical-writing half tone images is performed. In this γ-correction processing, 16-step half tone color (Y, C, M and K) images (patches) are formed on the intermediate transfer belt 4l (Step 716). The toner images are detected by the optical sensors (Step 717) to determine the amounts of toner adhered to the half tone images (Step 718). In addition, a graph illustrating the relationship (i.e., half tone characteristic) between the writing condition (the light quantities) of the laser diode and the amounts of toner adhered to the electrostatic images is prepared to calculate the deviation from the targeted half tone characteristic (Step 719). The writing condition of each of the laser diodes is corrected on the basis of the calculation result. The correction data (process controlling γ table) are fed back to the gamma characteristic γ in optical writing (Step 720). Thus, all the self-check operations are completed, and therefore the plotter is shut down (Step 721).

By performing the above-mentioned self-check operations, images having good image qualities can be stably produced even when the environmental conditions change and/or image forming members gradually degrade.

In this printer, when an order of driving the toner supplying device is made but the output voltage from the toner concentration sensor is hardly increased, the controller determines that the toner is hardly present in the toner cartridge (i.e., the toner cartridge is in a near-end state). Namely, the controller judges that the amount of toner remaining in the toner cartridge 900 is little, and therefore the amount of the toner fed by the toner supplying device per unit time is decreased. In this near-end judgment, the threshold of the output voltage from the toner concentration sensor is calculated from the sensitivity information stored in the memory chip in the memory circuit board and the targeted output voltage Vt_ref. For example, the output voltage Vt which is output by the sensor when detecting a developer whose toner concentration is decreased by 1% is determined on the basis of the sensitivity information. The thus determined output voltage Vt is used as the threshold for the near-end judgment. In a case where although the toner supplying device is operated, the output voltage Vt from the sensor is still greater than the thus determined threshold, the controller judges that the toner cartridge is in a near-end state.

Next, other examples of the printer, which have other additional features, will be explained.

FIRST EXAMPLE

In the above-mentioned printer, the level adjustment voltage Vcnt in the initial developer supply judgment processing is set to 4.5 V. However, there is a case where, depending on the sensor used, it is preferable that the level adjustment voltage is set to a voltage different from 4.5 V in view of judgment precision.

In this first example printer, a level adjustment reference voltage Vcnt_0, which is a reference voltage of the level adjustment voltage Vcnt, is also stored in the memory chip in the memory circuit board of each of the developing unit. In the initial developer supply judgment processing, the controller performs controlling such that the level adjustment reference voltage Vcnt_0 is read from the memory chip, and a level adjustment voltage Vcnt equal to the level adjustment reference voltage Vcnt_0 is applied to the toner concentration sensor to determine whether the initial developer is present (i.e., Step 8 in FIG. 6). Because of having such a configuration, this first example printer has an advantage in that the judgment precision thereof is better than in the case where the level adjustment voltage Vcnt is set to a certain voltage without considering the variation of the sensors.

SECOND EXAMPLE

Figure 10:
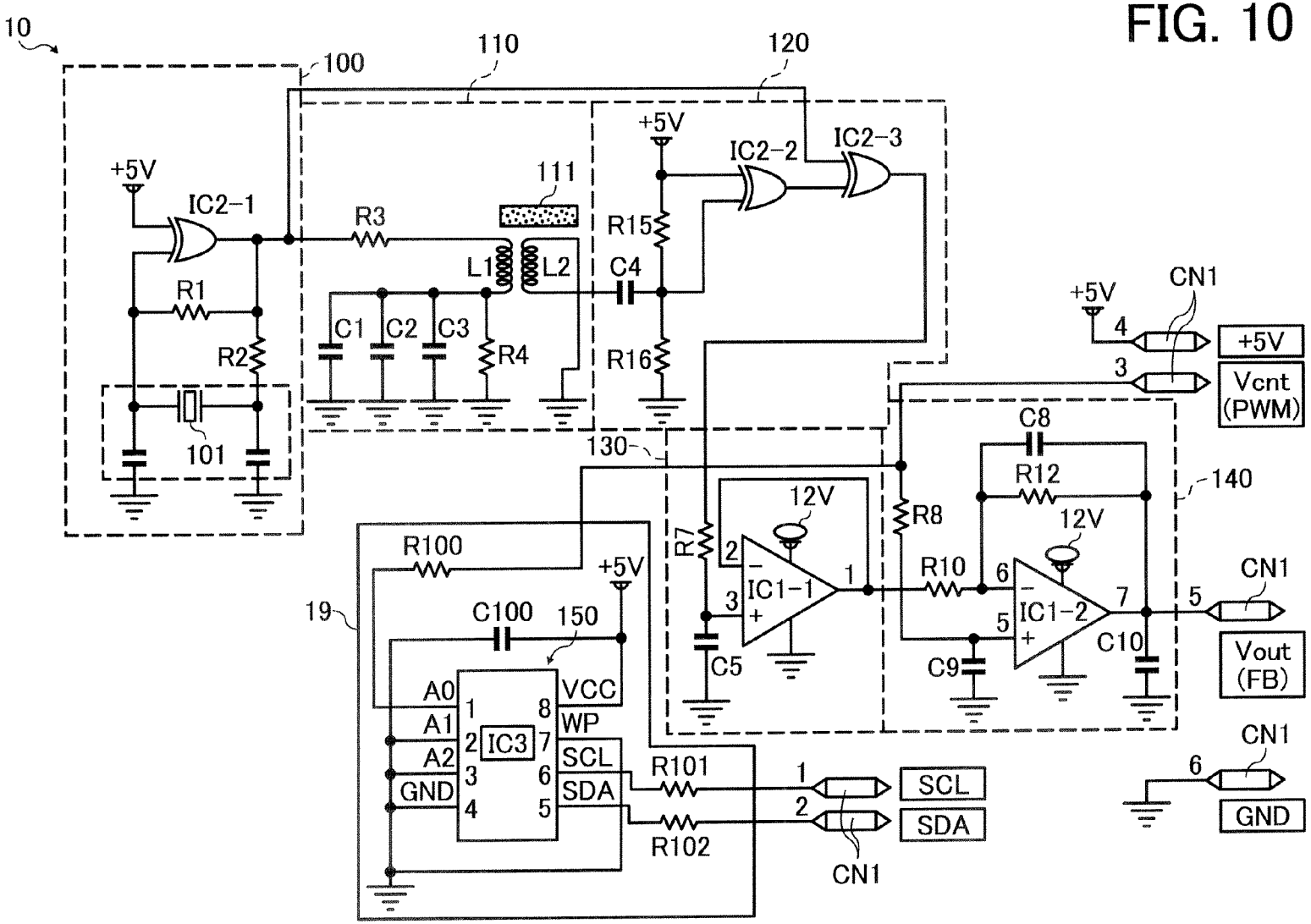
FIG. 10 is a circuit diagram illustrating the internal circuit of the toner concentration sensor and the circuit of the memory circuit board of the printer.

FIG. 10 is a circuit diagram illustrating the internal circuit of the toner concentration sensor and the circuit of the memory circuit board of a second example printer of the present invention. Since the same toner concentration sensor and memory circuit board are used for the developing units 7Y, 7C, 7M and 7K, the suffix Y, C, M or K is omitted in FIG. 10.

Referring to FIG. 10, the toner concentration sensor 10 includes an oscillation circuit 100, a resonance circuit 110, a phase comparison circuit 120, a smoothing circuit 130, an amplification circuit 140, etc. In addition, the memory circuit board 19 fixed on the upper surface of the casing of the developing unit 7 includes the memory chip 150 as mentioned above.

Figure 11:
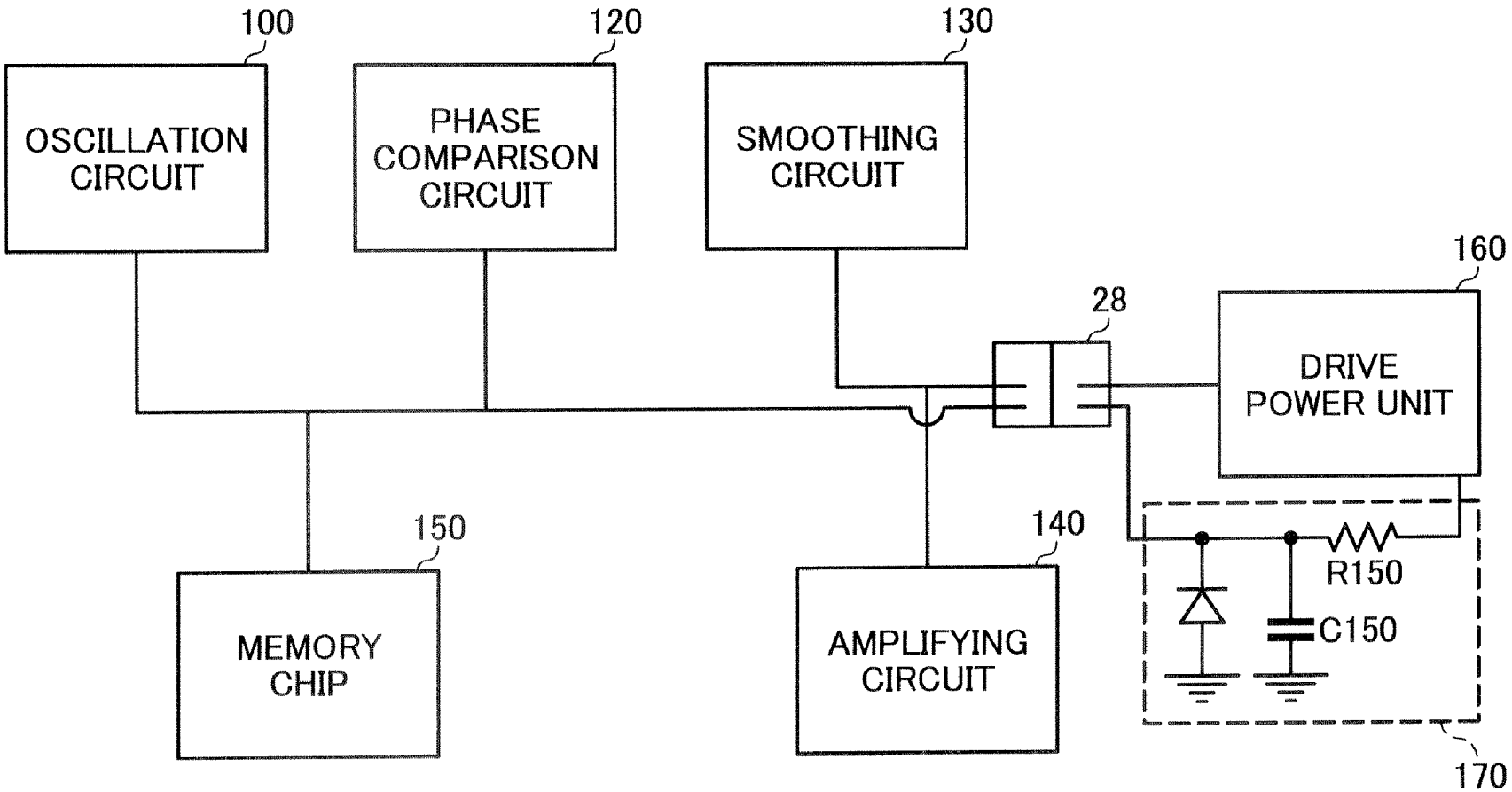
FIG. 11 is a circuit diagram illustrating the circuit of the driving power source for driving the toner concentration sensor and the memory circuit board, and the status of connection between the sensor and the memory chip in the printer.

FIG. 11 is a circuit diagram illustrating the circuit of a driving power source 160 for supplying a power to each of the circuits, and the connection state of the sensor 10 and the memory chip 150. Referring to FIG. 11, the driving power source 160 and a voltage reduction circuit 170 are fixed to the main body of the printer. The oscillation circuit 100, phase comparison circuit 120, smoothing circuit 130 and amplification circuit 140 are provided in the toner concentration sensor 10, which is provided in the developing unit 7. As mentioned above, the developing unit 7 is detachably attached to the printer. The memory chip 150 is arranged in the memory circuit board which is provided in the developing unit 7.

When the developing unit 7 is attached to or detached from the main body of the printer, the driving power source 160 supplying a driving power has to be disconnected with the toner concentration sensor and the memory circuit board. Specifically, in this printer, the driving power source 160 is connected with the toner concentration sensor and the memory circuit board via a connector 28. By disengaging a male connector with a female connector of the connector 28, the driving power source 160 can be disconnected with the toner concentration sensor and the memory circuit board.

The driving power source 160 outputs a voltage of about 12 V. It is necessary to supply a voltage of 12 V to the smoothing circuit 130 and the amplification circuit 140, and therefore the driving power source is connected with the smoothing circuit and the amplification circuit via the connector 28. Accordingly, a voltage of 12 V is applied to an OP amplifier provided in the smoothing circuit 130 and an OP amplifier provided in the amplification circuit 140.

In contrast, it is necessary to supply a driving voltage of 5 V to the oscillation circuit 100 and the phase comparison circuit 120 of the toner concentration sensor, and the memory chip. When a voltage of 12 V is applied thereto, problems such as false operations and failure of the devices are caused. In order to avoid such problems, the voltage reduction circuit 170 is provided on an upstream side from the connector 28 in a line connecting the oscillation circuit 100, phase comparison circuit 120 and the memory chip 150 with the driving power source to reduce the voltage of 12 V output from the driving power source 160 to a voltage of 5 V. Thus, a voltage of 5 V can be supplied to the oscillation circuit 100, phase comparison circuit 120 and the memory chip 150.

The voltage reduction circuit 170 may be provided in the driving power source 160. When the information stored in the memory chip is read or information is written in the memory chip, it is necessary to supply a driving power to the memory chip 150. The memory chip 150 has to be connected with a signal line through which the memory chip communicates with the controller, and another signal line through which a writing order or a reading order is made as well as the power line through which the driving power is supplied. In a case of popular memory chips, another line through which a power is supplied to maintain the information stored in the memory chip is necessary. However, since the printer of the present invention uses a non-volatile memory for the memory chip 150, this line is unnecessary. Namely, even when the driving power source 160 is disconnected with the memory chip 150, the information stored in the memory chip can be maintained.

Figure 12A:
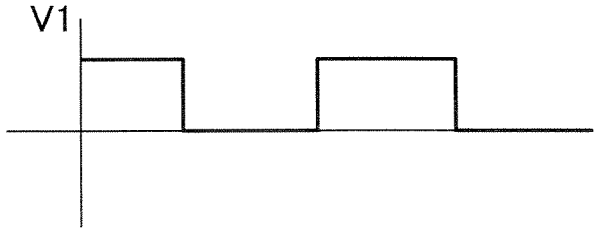
FIG. 12 is a graph illustrating the waveforms of the signals formed in the toner concentration sensor.

Referring to FIG. 10, the oscillation circuit 100, to which a voltage of 5 V is applied from the driving power source 160 via the voltage reduction circuit 170, generates a signal with a frequency of about 4 MHz using an oscillator 101 made of a material such as quartz and ceramics. Specifically, the oscillation circuit converts a voltage of 5 V to a rectangular pulse with a voltage of $V_1$ and a frequency of about 4 MHz as illustrated in FIG. 12A, and outputs the pulse to the resonance circuit 110.

The resonance circuit 110 includes a first resonance circuit having a resistor $R_3$ and a first coil $L_1$; a second resonance circuit having a second coil $L_2$ connected with the first coil $L_1$ with a magnetic connection coefficient of k; and a shared condenser including three condensers $C_1$, $C_2$ and $C_3$, which are shared by the first and second resonance circuits. When the first and second resonance circuits share the condenser, the circuits have similar resonance characteristics. The second coil $L_2$ is arranged so as to face the first coil $L_1$, resulting in formation of a resonance point. The output $V_1$ from the oscillation circuit 100 is input to the first coil $L_1$ via the resistor $R_3$. In this case, the input impedance at the resonance point can be increased. In addition, occurrence of a problem in that the oscillation circuit 100 cannot stably oscillate by the influence of the resonance circuit 110 can be prevented by the resistor $R_3$. Each of the first coil $L_1$ and the second coil $L_2$ has a self-inductance of 8.15 μH.

In the second resonance circuit, the voltage $V_2$ is output from the second coil $L_2$ to cancel the voltage $V_1$ input to the first coil $L_1$ at the resonance point. When the magnetic permeability of a developer 111 present in the vicinity of the first and second coils changes, the mutual inductance of the first and second coils changes, resulting in change of the voltage $V_2$ output from the second coil $L_2$.

Figure 12B:
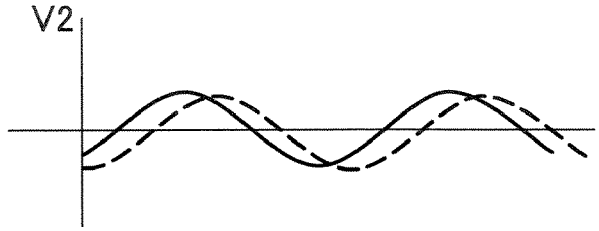

The magnetic permeability of the developer in the developing unit changes depending on the mixing ratio of the magnetic carrier and the non-magnetic toner. Specifically, the lower the toner concentration in the developer, the higher the magnetic permeability of the developer. As illustrated in FIG. 12B, the voltage $V_2$ output from the second coil $L_2$ is a sine wave. In FIG. 12B, the wave illustrated by a solid line represents an output voltage when the toner concentration is optimum, and the wave illustrated by a dotted line represents an output voltage when the toner concentration is lower than the optimum value. The dotted line wave has a phase different from that of the solid line wave. Thus, when the toner concentration in the developer changes, the mutual impedance at the resonance point changes, and the phase of the wave of the output from the second coil $L_2$ changes.

The voltage $V_2$ output from the second coil $L_2$, which has a sine wave form, is input to the phase comparison circuit 120. The phase comparison circuit 120 has an inversion amplifier IC2-2 for inverting the input sine wave, and a comparator IC2-3 for comparing the output $V_3$ from the inversion amplifier with the output $V_1$ from the oscillation circuit 100.

Figure 12C:
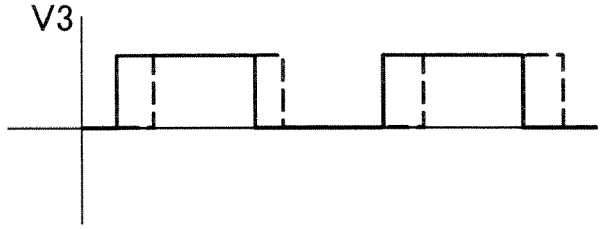
Figure 12D:
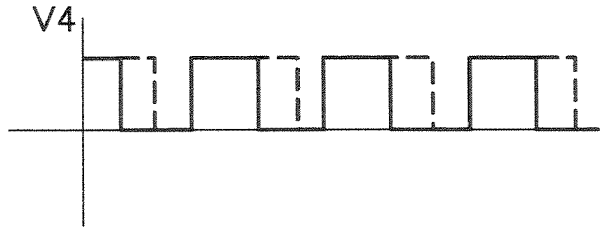

When a DC voltage, which is output from a power circuit (not shown), and the AC voltage $V_2$ output from the second coil $L_2$ are input to the inversion amplifier IC2-2, the inversion amplifier performs XOR calculation and outputs a rectangular pulse as illustrated in FIG. 12C. When the output $V_1$ from the oscillation circuit 120 (illustrated in FIG. 12A) and the output $V_3$ from the inversion amplifier IC2-2 (illustrated in FIG. 12C) are input to the comparator IC2-3, the comparator performs XOR calculation and outputs only a phase component as illustrated in FIG. 12D. It is clear from FIG. 12D that the pulse illustrated by a dotted line, which is output when the toner concentration is low, has a longer pulse width (i.e., a longer ON-time width) than the pulse illustrated by a solid line, which is output when the toner concentration is optimum. Thus, the phase comparison circuit outputs a voltage $V_4$ to the smoothing circuit 130.

Figure 12E:
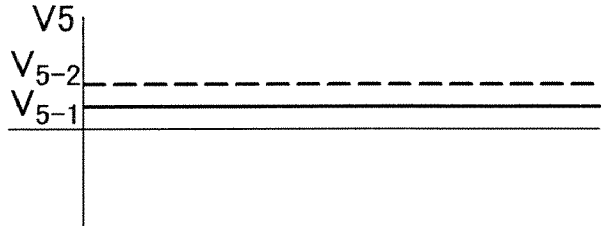

The smoothing circuit 130 has an OP amplifier IC-1, which outputs a flat wave $V_5$ as illustrated in FIG. 12E. The flat wave $V_5$ illustrates the average of the output $V_4$. When the toner concentration is optimum, an output voltage $V_{5-1}$ indicated by a solid line is output. In contrast, when toner concentration is relatively low, an output voltage $V_{5-2}$ indicated by a dotted line is output. It is clear from FIG. 12E that the output voltage $V_{5-2}$ is greater than the output voltage $V_{5-1}$. This is because the pulse illustrated by the dotted line in FIG. 12D, which is output when the toner concentration is low, has a longer pulse width than the pulse illustrated by the solid line.

The output voltage $V_5$ from the smoothing circuit 130 is amplified by the amplification circuit 140. Even when the toner concentration is maximally changed, the change of the output voltage $V_5$ is about 0.5 V. In the amplification circuit 140, the difference between the control voltage Vcont and the output voltage $V_5$ is amplified by four times. After the amplification operation, the output voltage Vout is output from the toner concentration sensor 10.

Figure 13:
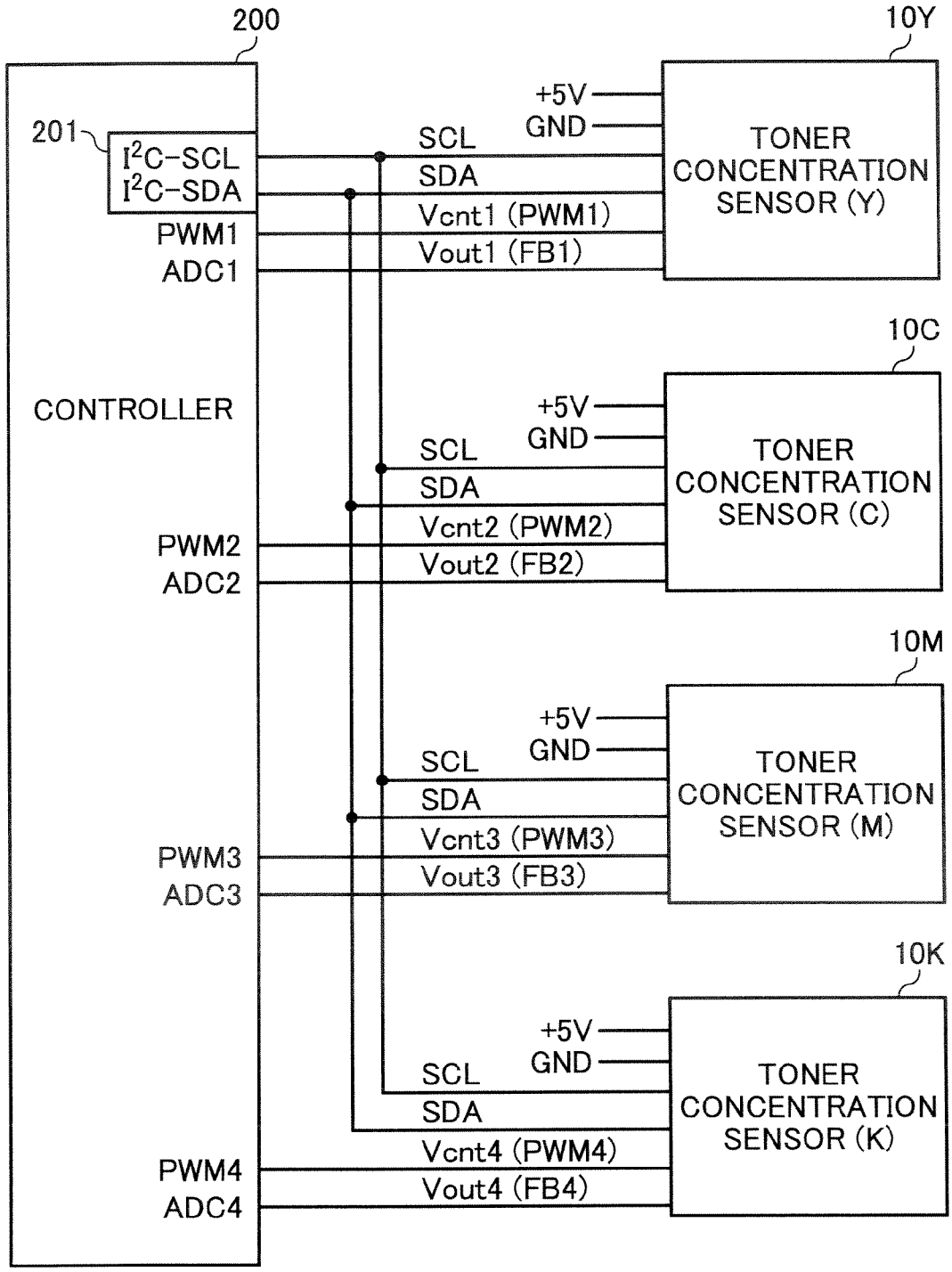
FIG. 13 is a circuit diagram illustrating the status of connection between the toner concentration sensors and the controller of the printer.

FIG. 13 is a circuit diagram illustrating the connection between the toner concentration sensors 10Y, 10C, 10M and 10K and a controller 200 of the printer. The controller 200 is fixed to the main body of the printer, and includes a CPU (not shown) a RAM (not shown), etc., or an ASIC having a function of a combination of a CPU, a RAM, etc. The controller 200 has four PWM terminals PWM1-PWM4 from which pulse width modulation (PWM) signals are output for the toner concentration sensors 10Y, 10C, 10M and 10K, respectively. In addition, the controller 200 has four ADC terminals ADC1-ADC4, to which voltages Vout (which is synonymous with the voltage Vt mentioned above) are input from the toner concentration sensors 10Y, 10C, 10M and 10K, respectively.

A PWM signal is such that a high level (i.e., a voltage of 5 V in this example) and a low level (i.e., a voltage of 0 V in this example) are output while switched at a predetermined frequency. As mentioned above, it is necessary to input various level adjustment voltages to each of the toner concentration sensors 10. When a fine adjustment circuit is used for finely controlling the level adjustment voltage, the costs of the controller increase. Therefore, in the printer of the present invention, the ON/OFF ratio (i.e., the duty) of pulses are changed instead of changing the level of pulses. In this case, the same effects can be obtained. Namely, even when the controller 200 outputs only a pulse of 5 V, information such as a voltage Vcnt on a level of 4.5 V can be input to the toner concentration sensor by using this method.

Analog signals of the output voltage Vout (Vt) are input to the terminals ADC1-4*m*, respectively, from the toner concentration sensors 10Y, 10C, 10M and 10K. The analog signals are converted to digital signals by an A/D converter (not shown) provided in the controller 200. Thereby, the output voltages from the toner concentration sensors 10 are informed to the controller 200.

The controller 200 also includes a master device 201 having a serial clock (SCL) terminal and a serial data (SDA) terminal. These terminals are not individually connected with the toner concentration sensors 10, but are commonly connected therewith as illustrated in FIG. 13. However, since unique addresses are allocated to the memory chips provided in the toner concentration sensors 10, the master device 201 can communicate with each of the toner concentration sensors 10.

Referring to FIG. 10, the level adjustment voltage Vcnt serving as a PWM signal and output from the controller is input to an OP amplifier IC1-2 of the amplification circuit 140. The signal line transporting the level adjustment voltage Vcnt to the OP amplifier IC1-2 is also connected with an A0 terminal of the memory chip 150 of the memory circuit board 19. The A0 terminal serves as a terminal from which a write instruction signal or a read instruction signal is output to be input to the memory chip 150. Namely, in this printer, one line is used as a signal line through which the level adjustment voltage Vcnt is transmitted from the controller 200 to the toner concentration sensors and another signal line through which an information write instruction signal or an information read instruction signal is transmitted to the memory chip 150.

The write instruction signal sent to the memory chip 150 has a voltage greater than 0 V, and the read instruction signal has a voltage of 0 V. In this regard, when the level adjustment voltage Vcnt output from the controller 200 is accidentally equal to the voltage of the information write instruction signal, a write instruction is mistakenly made to the memory chip 150. Therefore, in this printer, the voltage of the information write instruction signal is set to 5 V which is equal to the high level of the PWM signal. In addition, the upper limit of the level adjustment voltage is set to a voltage (e.g., 4.7 V) which is lower than the voltage of the information write instruction signal. Such a configuration can prevent occurrence of a problem in that when the level adjustment voltage Vcnt is input to the toner concentration sensor, a write instruction is mistakenly made to the memory chip 150. Even in a case where the level adjustment voltage Vcnt is not a PWN signal but is a voltage which is analogously adjusted voltage output from a voltage adjustment circuit, the above-mentioned mis-write instruction problem can be avoided by differentiating the level adjustment voltage Vcnt from the voltage of the information write instruction signal.

Just after a power source (not shown) is turned on, the controller 200 stops controlling of the master device 201 ($I^2C$) to allow the SCL and SDA to achieve a non-active state. Therefore, the memory chips 150 do not communicate with the controller 200. Accordingly, even when no voltage is applied to the A0 terminals of the memory chips, information reading is not performed in the memory chips.

Next, the controller 200 outputs the level adjustment signal Vcnt (PWM signal) (e.g., 4.5 V) to each of the toner concentration sensors to determine whether or not each of the toner sensors outputs a voltage Vt of greater than 0 V. When an output voltage Vt greater than 0 V is not received, it is considered that the corresponding developing unit is not set or the male and female connectors illustrated in FIG. 11 are not connected. In this printer, the signal line SCL connected with the PWM terminal and the signal line SDA connected with the ADC terminal are connected with the toner concentration sensors via the connector 28. When an output voltage Vt greater than 0 V is not received, a message "An error occurs because the corresponding developing unit is not set or the connector is not connected" is displayed in the operation panel.

When it is judged that all the developing units are normally set, it is then checked whether each of the developing units is a new developing unit. In this case, the controller 200 reads brand-new flag information stored in the memory chip to determine whether the unit is set. Namely, in this printer, brand-new flag information, which is specific information on individual developing unit, is stored in the memory chip thereof. When the developing units are shipped from a factory, the brand-new flag information is set to a value (such as 1) representing the setting state. In addition, when the above-mentioned output adjustment processing in the initial developer detection operation is normally completed, the brand-new flag information is updated so as to be a value (such as 0) representing the cleared state. Therefore, by checking whether the brand-new flag information is a setting-state value or a cleared-state value, it can be determined whether or not the developing unit is a new developing unit. When the brand-new flag information in the memory chip is read, the master device 201 of the controller 200 outputs an addressing signal and a signal specifying the brand-new flag information while each of the level adjustment voltages Vcnt for the toner concentration sensors 10 is set to 0 V. Thereby, the brand-new flag information and a read instruction signal (e.g., 0 V) are sent to the memory chip of any one of the developing units 7Y, 7C, 7M and 7K. The updated brand-new flag information is sent, as a serial data, from the memory chip to the SDA.

After the brand-new detection operation mentioned above is ended, a mis-setting judgment processing is performed. In this processing, the color information stored in the memory chip is read by the controller 200. Namely, in this printer, the color information is also stored in the memory chip. Specifically, the memory chip of the yellow developing unit 10Y stores yellow color information. By comparing the read color information with the color corresponding to the specified address, occurrence of a mis-setting problem in that, for example, the black developing unit is set in the position of the yellow developing unit can be prevented. When reading the color information, communication is made between the memory chip and the controller 200 similarly to the case of reading the brand-new flag information. When mis-setting is detected, the controller displays a mis-setting detection error message in the operation panel.

The memory chip can include specific information on history of parts of the developing unit such as usage information, and accident information and usage time (e.g., the number of produced copies) as well as the specific information on the developing unit ID and brand-new flag information mentioned above. In this case, it can be judged whether the developing unit expires. In addition, other information such as maintenance service company information, information on expiration of consumable supplies and information on the manufacturing date of the developing unit can be stored therein.

In the above-mentioned printers, the memory chip is provided separately from the toner concentration sensor, but may be provided in the toner concentration sensor. In a case where the memory chip is arranged separately from the toner concentration sensor, a marketed general-purpose high-sensitive sensor can be used as the toner concentration sensor. When the memory chip is arranged in the toner concentration sensor, a special sensor has to be used as the toner concentration sensor, resulting in increase of manufacturing costs of the sensor.

THIRD EXAMPLE

In the third example printer of the present invention, information on the agitation speed of the second feeding screw 11 is stored in the memory chip of the developing unit. In the above-mentioned initial developer supply judgment processing, a process motor is rotated at a predetermined rotation speed to apply a driving force to the developing unit. Therefore, the agitation speed falls in a range including a variation of the drive transmission system. Therefore, under normal conditions, the developer presence/absence judgment processing is hardly influenced even when the agitation speed is not considered. However, as mentioned above, when a model change of the developing unit is performed, there is a case where the gear ratio of the new model is different from that of the old model. In this case, the coefficients (i.e., $\alpha$, $\beta$, $\gamma$ and k) of the equations (1) and (2) used for the correction of the blank reference voltage Vt_0*a* and the initial developer reference voltage Vt_0*b* are deviated from the proper values.

Therefore, in this third example printer, the coefficients are corrected on the basis of the information on the agitation speed stored in the memory chip. Alternatively, preferable values of the coefficients maybe stored in the memory chip instead of the agitation speed information.

Hereinbefore, color printers using plural process units 1Y, 1C, 1M and 1K have been explained. However, the present invention can also be used for monochrome image forming apparatus, which produce only monochrome images using one photoreceptor drum and one developing device.

In addition, in the above-mentioned printers, the memory chip 150 is provided on the developing unit serving as a developing device. However, the memory chip can be provided on a process unit including the developing device.

In the above-mentioned printers, the memory chip 150, which is a characteristic information storage device capable of electrically storing characteristic information such as the blank reference voltage Vt_0*a*, is used as a character information storage medium. Therefore, it is possible that the controller 200 can read the characteristic information, and thereby a trouble such that the user has to read a barcode including the characteristic information can be saved.

Further, in the above-mentioned printers, the blank reference voltage Vt_0*a* is previously stored, as a reference value of the output from the toner concentration sensors 10, in the memory chip serving as a character information storage device, and the output voltage Vt from the toner sensors are compared with the blank reference voltage. On the basis of the comparison result, the controller performs the initial developer presence/absence judgment processing (Step 8 in FIG. 6) in which whether or not the initial developer is present in the second developer container 14 is determined. Therefore, even when a high-sensitive sensor is used as the toner concentration sensor, occurrence of mis-judgment in the initial developer presence/absence judgment processing due to large individual variation of the high-sensitive sensors can be prevented.

In the third example printer, the information on the agitation speed of the second feeding screw serving as an agitation device is stored in the memory chip. In the developer presence/absence judgment processing, the controller performs controlling such that the blank reference voltage Vt_0*a* is corrected on the basis of the agitation speed. Therefore, even when the agitation speed of the second feeding screw is changed due to, for example, model change of the developing device, the blank reference voltage Vt_0*a* can be properly corrected, and thereby presence and absence of the initial developer can be properly judged. Namely, occurrence of mis-judgment due to change of the agitation speed can be prevented.

In the first example printer, the level reference voltage Vcnt_0, which is a reference value of the level adjustment signal (i.e., the level adjustment voltage Vcnt) to be input to the toner concentration sensor to adjust the level of the signal output from the toner concentration sensor, is stored in the memory chip. In the developer presence/absence judgment processing (Step 8 in FIG. 6), the controller performs controlling such that the output from the toner concentration sensor, to which a level adjustment signal Vcnt equal to the level adjustment reference voltage Vcnt_0 is input, is compared with the blank reference voltage Vt_0*a* to determine whether the initial developer is present in the developing device. Therefore, the precision of the developer presence/absence judgment processing can be relatively improved compared to a case where a predetermined level adjustment voltage Vcnt is input to the toner concentration sensor even when the sensor used for the toner concentration sensor has large individual sensitivity variation.

In the above-mentioned printers, the initial developer container 17 configured to contain a new developer including a toner in an amount of 5% by weight is provided separately from the developer containers (such as containers 9 and 14). The controller performs the initial developer supply judgment processing illustrated in FIG. 6 in which whether the initial developer is properly input from the initial developer container to the developer containers is determined on the basis of the judgment in the developer presence/absence judgment processing. Therefore, whether the initial developer in the initial developer container is properly supplied to the developer containers can be properly determined on the basis of the judgment in the developer presence/absence judgment processing.

In the above-mentioned printers, the controller performs controlling such that when it is judged in the initial developer supply judgment processing (illustrated in FIG. 6) that the initial developer is properly supplied, the level adjustment voltage Vcnt to be input to the toner concentration sensor is adjusted so that the voltage Vt_1 output from the toner concentration sensor falls in a predetermined range. Receiving an output voltage Vt_1 falling out of the predetermined range (e.g., 2.7 V±0.2 V) means problems such as use of an abnormal sensor or defective connection of a connector. Therefore, such problems can be avoided.

In the above-mentioned printers, the controller may perform controlling such that when the output voltage Vt_1 is adjusted to fall in the predetermined range, a level adjustment judgment processing, in which whether the level adjustment voltage Vcnt falls in the predetermined range is determined, is performed. In this case, it is possible to detect an abnormal toner concentration sensor.

In the above-mentioned printers, in addition to the blank reference voltage Vt_0*a*, the initial developer reference voltage Vt_0*b*, which is the second reference of the output signal from the toner concentration sensor, is also stored in the memory chip. The controller performs controlling such that whether the developer in the developer container is the initial developer is judged on the basis of the result of comparison of the initial developer reference voltage Vt_0*b* with the output from the toner concentration sensor. In this regard, only when the developer is the initial developer, the initial developer output adjustment processing is performed. Therefore, problems due to setting of a used developing unit such that the concentration of toner in the developer is excessively high and toner in the developing unit scatters can be avoided.

In the above-mentioned printers, when the initial developer supply operation is judged to be improper in the initial developer supply judgment processing or the output voltage from the toner concentration sensor cannot be controlled to fall in the predetermined range (e.g., 2.7 V±0.2 V) in the initial developer output adjustment processing, the controller performs a processing in that an error message is displayed in an operation panel serving as a warning device. Therefore, when the initial developer is not normally set or the toner sensor is abnormal, the user is warned so as to notice the problem.

In the second example printer mentioned above, one line is commonly used as the signal line, through which the level adjustment voltage Vcnt is transmitted from the controller to the toner concentration sensor, and the signal line, through which the information write instruction signal or information read instruction signal is transmitted from the controller to the memory chip, as illustrated in FIG. 10. Therefore, the size and costs of the printer can be reduced.

In addition, in the second example printer, the controller performs controlling such that the level adjustment voltage Vcnt is different from the voltage of the information write instruction signal or information read instruction signal. Therefore, occurrence of a problem in that when inputting of a level adjustment voltage Vcnt to the toner concentration sensor mistakenly issues a write instruction to the memory chip can be prevented.

Further, in the second example printer, the connector (having a reference number 28 in FIG. 11) is commonly used as the connector for cutting the signal line through which the level adjustment voltage Vcnt is transmitted from the controller to the toner concentration sensor and the connector for cutting the signal line, through which the information write instruction signal or information read instruction signal is transmitted from the controller to the memory chip. Therefore, by performing one operation, both the signal lines can be cut, resulting in improvement in operationality.

Furthermore, in the second example printer, the controller performs controlling such that the level adjustment voltage Vcnt (greater than 0V) is input to the toner concentration sensor while communication between the controller and the memory chip is stopped. Therefore, the communication between the controller and the memory chip can be performed separately from receiving of the output voltage Vt from the toner concentration sensor.

The above-mentioned printers includes the optical sensors 137 and 138 configured to measure the amount per unit area of toner of the reference toner images (patches) transferred to the intermediate transfer belt from the photoreceptor, and the toner supplying device configured to supply the toner to the developer container. In addition, the sensitivity information of the toner concentration sensor is previously stored in the memory chip. Further, the controller performs controlling such that the target output voltage Vt_ref of the signal output from the toner concentration sensor measuring the concentration of the developer in the second developer container is corrected on the basis of the sensitivity information and the detection result of the sensor, and then the toner supplying device is driven on the basis of the corrected target output voltage Vt_ref and the output voltage Vt from the toner concentration sensor. Therefore, even when the sensor has a large individual variation, the target output voltage Vt_ref can be properly corrected, and thereby the toner concentration can be properly controlled.

In addition, the above-mentioned printers have plural developing units each having a toner concentration sensor. The controller performs controlling such that self-checking is performed on the basis of the output signal from the toner concentration sensor. Therefore, the target output voltage Vt_ref of each developing unit can be properly corrected.

In the above-mentioned printers, the controller performs controlling such that the correction operations of the target output voltages Vt_ref for the plural developing units are performed in parallel in the self-checking operation of the developing unit. Therefore, the time needed for the self-checking operation can be shortened. In addition, in the initial driving operations of the developing units, the initial developer supply judgment processing illustrated in FIG. 6 and the initial developer output adjustment processing illustrated in FIG. 7 have to be performed for each of the developing devices. Even in this case, the processings can be performed in parallel for the plural developing units.

The above-mentioned printers include a non-volatile memory chip as the character information storage device. Therefore, the information stored in storage device can be maintained without using a power source such as batteries in the distribution process of from a factory to a user.

In the second example printer, the driving power source 160 used for supplying a driving power to the toner concentration sensors 10 is also used for supplying a driving power to the memory chip 150. In addition, the driving power source 160 supplies a power to the memory chip 150 via the voltage reduction circuit 170. Therefore, the costs of the printer can be reduced.

In the above-mentioned printers, specific information (such as IDs) of each of the plural developing units is stored in the memory chip thereof. Therefore, controlling in replacement of the developing units can be performed on the basis of the information.

This document claims priority and contains subject matter related to Japanese Patent Application No. 2006-163567, filed on Jun. 13, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A developing device, comprising:

a developer bearing member configured to bear thereon a developer including a toner and a magnetic carrier to develop an electrostatic image on an image bearing member with the developer;

a developer container configured to contain the developer therein and feed the developer to the developer bearing member;

a toner concentration sensor configured to detect a concentration of the toner in the developer in the developer container and output a signal depending on the detected toner concentration; and a characteristic information storage device provided on a casing of the developing device and configured to store a characteristic of the toner concentration sensor including a blank reference voltage and an initial developer reference voltage prior to the developing device being attached to an image forming apparatus, wherein the characteristic information storage device is separated from the toner concentration sensor and a corrected value of the blank reference voltage and a corrected value of the initial developer reference voltage are compared with the signal output by the toner concentration sensor to determine whether a new developer is present in the developer container.

2. A process unit, comprising:

an image bearing member configured to bear an electrostatic image thereon; and a developing device configured to develop the electrostatic image with a developer including a toner and a magnetic carrier to form a toner image on the image bearing member, the developing device comprising:

a developer bearing member configured to bear thereon a developer including a toner and a magnetic carrier to develop an electrostatic image on an image bearing member with the developer;

a developer container configured to contain the developer therein and feed the developer to the developer bearing member;

a toner concentration sensor configured to detect a concentration of the toner in the developer in the developer container and output a signal depending on the detected toner concentration; and a characteristic information storage device provided on a casing of the developing device and configured to store a characteristic of the toner concentration sensor including a blank reference voltage and an initial developer reference voltage prior to the developing device being attached to an image forming apparatus, wherein the characteristic information storage device is separated from the toner concentration sensor and a corrected value of the blank reference voltage and a corrected value of the initial developer reference voltage are compared with the signal output by the toner concentration sensor to determine whether a new developer is present in the developer container, wherein the process unit is configured to be detachably attached to the image forming apparatus.

3. An image forming apparatus, comprising:

at least one image bearing member configured to bear an electrostatic image thereon;

at least one developing device, comprising:

a developer bearing member configured to bear thereon a developer including a toner and a magnetic carrier to develop the electrostatic image on the at least one image bearing member with the developer;

a developer container configured to contain the developer therein and feed the developer to the developer bearing member;

a toner concentration sensor configured to detect a concentration of the toner in the developer in the developer container and output a signal depending on the detected toner concentration; and a characteristic information storage device configured to store a predetermined reference value of a signal output from the toner concentration sensor prior to the developing device being attached to the image forming apparatus; and a controller configured to perform controlling based on the output signal from the toner concentration sensor of the at least one developing device and configured to determine whether or not a new developer is present in the developer container by comparing the predetermined reference value of the signal output with a value of an actual signal output from the toner concentration sensor when the developing device is attached to the image forming apparatus.

4. The image forming apparatus according to claim 3, further comprising:

an intermediate transfer medium configured to receive a toner image from the image bearing member to transfer the toner image to a receiving material;

a toner amount detection device configured to measure an amount per unit area of the toner in the toner image on the image bearing member or the intermediate transfer medium; and a toner supplying device configured to supply the toner to the developer container, wherein the characteristic information storage device stores information on a sensitivity of the toner concentration sensor, and wherein the controller performs controlling such that a target of the signal output from the toner concentration sensor is corrected based on the sensitivity information and the information on the toner amount from the toner amount detection device, and the toner supplying device is controlled based on the corrected target of the output signal and the output signal from the toner concentration sensor.

5. The image forming apparatus according to claim 3, including plural developing devices, or plural process units each including an image bearing member and a developing device, wherein the controller performs controlling on each of the plural developing devices or each of the plural process units based on the signal output from the corresponding toner concentration sensor.

6. The image forming apparatus according to claim 5, wherein the controller performs controlling in parallel on the plural developing devices or the plural process units.

7. The image forming apparatus according to claim 3, wherein the characteristic information storage device is a non-volatile information storage device.

8. The image forming apparatus according to claim 3, further comprising:

a first power source configured to supply a first driving power to the toner concentration sensor;

a second power source configured to supply a second driving power to the characteristic information storage device; and a voltage reduction device configured to reduce a voltage, wherein the first power source serves as the second power source, and wherein the voltage reduction device reduces a voltage of the first driving power or the second driving power.

9. The image forming apparatus according to claim 3, including plural developing devices, or plural process units each including an image bearing member and a developing device, wherein specific information on each of the plural developing devices or the plural process units is stored in the corresponding characteristic information storage device.

10. The image forming apparatus according to claim 3, wherein the at least one image bearing member and the at least one developing device are detachably attached to the image forming apparatus as a unit.

11. The image forming apparatus according to claim 3, wherein the developing device further includes:

an agitating member configured to agitate the developer in the developer container, wherein the characteristic information storage device further stores information on an agitation speed of the agitation member, and wherein the controller corrects the predetermined reference value based on the agitation speed information.

12. The image forming apparatus according to claim 3, wherein the characteristic information storage device further stores information on a reference value of a level adjustment signal, which is input to the toner concentration sensor to adjust a level of the signal output from the toner concentration sensor, and wherein the controller judges whether the new developer is present in the developer container based on a result of the comparing the predetermined reference value, to which a level adjustment signal equal to the level adjustment reference value is input, with the value of the actual signal output.

13. The image forming apparatus according to claim 12, wherein the controller outputs the level adjustment signal to the toner concentration sensor while stopping communication with the characteristic information storage device.

14. The image forming apparatus according to claim 12, wherein the developing device further comprises:

an initial developer container configured to contain the new developer including the toner at a predetermined concentration and supply the new developer to the developer container.

15. The image forming apparatus according to claim 14, further comprising:

a warning device configured to warn a user, wherein the controller allows the warning device to warn the user in at least one of a case where the controller judges that the new developer is not properly supplied, a case where the controller judges that the output signal from the toner concentration sensor cannot be controlled to fall in a predetermined range, and a case where the controller judges that the level adjustment signal is not in a predetermined range.

16. The image forming apparatus according to claim 14, wherein when the controller decides that the new developer is supplied to the developer container, the controller performs an initial developer output adjustment processing in which the level adjustment signal input to the toner concentration sensor is adjusted so that the signal output from the toner concentration sensor falls in a predetermined range.

17. The image forming apparatus according to claim 16, wherein the controller performs a level adjustment judgment process of determining whether the level adjustment signal by which the toner concentration sensor outputs the output signal in the predetermined range falls in a predetermined range.

18. The image forming apparatus according to claim 16, wherein the characteristic information storage device further stores a second reference output value of the output signal from the toner concentration sensor, and the controller judges whether the developer in the developer container is the new developer based on a result of a comparison of the second reference output value with the output signal from the toner concentration sensor, and wherein only when the developer is the new developer, the controller performs the initial developer output adjustment processing.

19. The image forming apparatus according to claim 3, wherein when the value of the actual signal output from the toner concentration sensor is not greater than an adjusted value of the predetermined reference value, than the new developer is not present in the developer container.

20. The image forming apparatus according to claim 3, wherein when the value of the actual signal output from the toner concentration sensor is not less than an adjusted value of the predetermined reference value, than the new developer is present in the developer container.

* * * * *